US008616730B2

(12) United States Patent
Edwards, Jr. et al.

(10) Patent No.: US 8,616,730 B2
(45) Date of Patent: Dec. 31, 2013

(54) VAPOR-TIGHT LIGHTING FIXTURE

(75) Inventors: Richard D. Edwards, Jr., Westerly, RI (US); Stanley A. Katz, Westerly, RI (US)

(73) Assignee: Greendot Technologies, LLC, Mansfield, MA (US)

( * ) Notice: Subject to any disclaimer, the term of this patent is extended or adjusted under 35 U.S.C. 154(b) by 337 days.

(21) Appl. No.: 13/041,807

(22) Filed: Mar. 7, 2011

(65) Prior Publication Data

US 2012/0229025 A1 Sep. 13, 2012

(51) Int. Cl.
*F21V 29/00* (2006.01)

(52) U.S. Cl.
USPC ..... 362/267; 362/225; 362/260

(58) Field of Classification Search
USPC ..... 362/147, 223, 225, 260, 267, 404
See application file for complete search history.

(56) References Cited

U.S. PATENT DOCUMENTS

| | | | | |
|---|---|---|---|---|
| 4,866,584 | A * | 9/1989 | Plewman | 362/225 |
| 5,412,549 | A * | 5/1995 | Blakely | 362/218 |
| 5,437,504 | A | 8/1995 | Halvatzis | |
| 5,716,123 | A * | 2/1998 | Lamming | 362/222 |
| 6,132,061 | A | 10/2000 | Andrus et al. | |
| 6,135,613 | A | 10/2000 | Bodell et al. | |
| 6,193,394 | B1 | 2/2001 | Herst et al. | |
| 6,386,736 | B1 | 5/2002 | Reiff et al. | |
| 6,425,681 | B1 | 7/2002 | Agabekov | |
| 6,561,676 | B1 | 5/2003 | Fischer et al. | |
| 6,749,322 | B2 | 6/2004 | Chen | |
| 6,962,425 | B1 | 11/2005 | Rhee | |
| 6,979,097 | B2 | 12/2005 | Elam et al. | |
| D549,382 | S | 8/2007 | Lee | |
| 7,284,878 | B2 | 10/2007 | Dorogi et al. | |
| 7,300,180 | B2 | 11/2007 | Hutchison et al. | |
| 7,303,310 | B2 | 12/2007 | You et al. | |

(Continued)

OTHER PUBLICATIONS

Edwards, "U.S. Appl. No. 29/386,937, Lighting Fixture With Tubular Lens", Mar. 7, 2011.

(Continued)

*Primary Examiner* — John A Ward
(74) *Attorney, Agent, or Firm* — Loginov & Sicard; William A. Loginov

(57) ABSTRACT

This invention provides a vapor-tight luminaire that maintains a moisture-proof, sealed lower housing for the light-producing lamps (fluorescent lights, LED arrays, etc.) while isolating the electronic components in a separate, upper housing that is spaced apart from, and largely thermally isolated from, the lamps. The lamp housing comprises a unitary non-penetrated tubular lens with one or more removable end caps, sealed by gaskets. The lamp assembly is slidably mounted within the lower housing so that it is readily removable and replaceable with another assembly of the same or different type. The electronics in the upper housing is readily accessible and replaceable by removing a top cover that encloses a three sided channel member. The upper housing is metal and desirably enhances heat exchange with the environment. The two housings are held together by a pair of opposing end cap structures that include a housing end and a removable end cap. The housing end includes an upper plate that is fastened against an adjacent end of the upper housing's channel member. This compresses gaskets that stand between the respective ends of the lens and a lower ring on each housing end. The electronics of the upper housing is interconnected via a wiring harness connector to an end connector in on the lamp assembly. The wiring harness passes between the two housings free of penetration of the lens.

38 Claims, 23 Drawing Sheets

(56) References Cited

U.S. PATENT DOCUMENTS

| | | | | |
|---|---|---|---|---|
| D589,199 | S | 3/2009 | Pedersen | |
| 7,513,675 | B2 | 4/2009 | Mier-Langner et al. | |
| 7,524,090 | B2 | 4/2009 | Hargreaves | |
| 7,674,005 | B2 | 3/2010 | Chung et al. | |
| 7,938,562 | B2 * | 5/2011 | Ivey et al. | 362/276 |
| 7,976,196 | B2 * | 7/2011 | Ivey et al. | 362/294 |
| 8,235,545 | B2 * | 8/2012 | Zheng et al. | 362/218 |
| 8,256,924 | B2 * | 9/2012 | Simon et al. | 362/249.03 |
| 8,360,593 | B2 * | 1/2013 | Kim et al. | 362/97.3 |
| 8,360,599 | B2 * | 1/2013 | Ivey et al. | 362/218 |
| 8,459,831 | B2 * | 6/2013 | Hsia et al. | 362/221 |
| 2006/0198132 | A1 | 9/2006 | Trigiani et al. | |
| 2008/0285266 | A1 | 11/2008 | Thomas | |
| 2010/0085768 | A1 | 4/2010 | Pickett et al. | |
| 2010/0103664 | A1 * | 4/2010 | Simon et al. | 362/234 |
| 2010/0103673 | A1 * | 4/2010 | Ivey et al. | 362/249.02 |
| 2010/0214785 | A1 | 8/2010 | Chen | |
| 2010/0220469 | A1 * | 9/2010 | Ivey et al. | 362/218 |
| 2010/0253226 | A1 | 10/2010 | Oki | |
| 2010/0271812 | A1 | 10/2010 | Harnischmacher et al. | |
| 2010/0271825 | A1 | 10/2010 | Black et al. | |
| 2010/0321921 | A1 * | 12/2010 | Ivey | 362/84 |

OTHER PUBLICATIONS

Edwards, "U.S. Appl. No. 29/386,949, Endcap for a Lighting Fixture With Tubular Lens", Mar. 7, 2011.

Edwards, "U.S. Appl. No. 29/386,951, Housing Assembly for a Lighting Fixture", Mar. 7, 2011.

Katz, "U.S. Appl. No. 29/395,953, Housing End for Lighting Fixture", Mar. 7, 2011.

"Enclosed & Gasketed Acrylic Tube, Severe Environment", Feb. 9, 2010, Publisher: Columbia Lighting, Published in: US.

* cited by examiner

VAPOR-TIGHT LIGHTING FIXTURE

FIELD OF THE INVENTION

This invention relates to lighting fixtures/luminaires for commercial and industrial applications and more particularly to high-energy-efficiency lighting fixtures.

BACKGROUND OF THE INVENTION

Traditional high-intensity luminaires (also popularly termed "fixtures") for installation in various indoor, outdoor and indoor/outdoor (e.g. parking areas) environments are weatherproof, having durable sealed lens covers that keep moisture, vapor and other contaminants away from their internal lamps, wiring and electrical components. Such luminaires are commonly termed "vapor-tight" fixtures/luminaires. These luminaires generally include a fluorescent lamp assembly within their housing. Currently available designs define a "clamshell" consisting of an elongated, opaque, upper box (typically of polymer material), having pendant mounting brackets, attached electronics (ballast, etc.), wiring, reflector assembly and a plurality of fluorescent lamps in a predetermined number and arrangement; a translucent lower lens having a top edge that mates with the bottom edge of the upper box; and a horizontally oriented and elongated sealing surface created by the upper housing and lower lens mating surfaces. This interface between the upper and lower portions of the luminaire incorporates an elastomeric-type gasket that creates a moisture and dust-resistant seal when a set of housing affixed sealing clamps are employed to compressibly join the housing and lens portions of the luminaire. However, the seal is subject to the effects of aging, and eventually fails over time. This is partially the result of the spacing between sealing clamps and the elongated nature of the horizontal sealing surface (which provides an uneven compression to the joint line) combined with aging of the materials, environmental changes and extremes in temperature. As the seal degrades it allows for the undesirable infiltration of moisture and contaminants. Because the seal is elongated and horizontal, it encourages the buildup and retention of moisture at the seal interface around the perimeter. The moisture seeks a lower level, which it achieves by migrating through any gaps in the seal around the relatively large and intermittently clamped perimeter. Once the moisture enters, it pools in the lens, causing fogging, staining of the lens and eventual failure of the wiring and electronics.

Shortened lamp and electronics (ballast, etc.) life due to moisture-based deterioration increases the costs of maintaining the luminaires, and shortened unit life leads to more frequent replacements and higher costs for the facility owner/operator.

A vapor-tight luminaire with an advanced and efficient reflector and lamp arrangement is provided in commonly assigned U.S. Pat. No. 7,588,347, entitled LIGHTING FIXTURE, by Richard D. Edwards, Jr., which is incorpotrated herein by reference as useful background information. This design provides superior optimetrics with two or three flourescent lamps. However, it relies upon existing vapor-tight housing technology as described generally above. This arrangement makes it difficult to access and service the electronics, as they are generally placed beneath the lamp assembly, requiring removal of a significant portion of the internal components to replace a ballast or other electronic element of the luminaire. Even where servicibility is a secondary concern, the placment of both the electronics and the lamp assembly in a single overall, sealed enclosure can prove problematic where certain types of lamps (e.g. LEDs or incandescent) or electronics generate sognificant heat, and that heat is essentially trapped within the sealed housing, degrading the internal components and potentially degrading the seal through heat damage.

It is, thus, highly desirable to provide a luminaire that uses fluorescent tubular lamps, or another type of elongated light source, which is vapor tight and reduces the deleterious effects on the housing and electronics brought upon by environmental conditions, among other factors. In particular, this luminaire should employ a housing arrangement that avoids the disadvantages of an elongated, horizontal intermittently clamped seal that is prone to accumulate moisture and allow it to migrate through a gap. This luminaire should be able to employ an advanced and efficient lamp arrangement and reflector design, and afford superior photometrics. This luminaire should be easily retrofit into existing structures in a variety of mounting arrangements, such as direct-to-ceiling, pendant, etc. Moreover, the underlying housing structure should allow for straightforward mounting of up-to-date lamp technologies, such as LED, plasma discharge, etc.

SUMMARY OF THE INVENTION

This invention overcomes disadvantages of the prior art by providing a vapor-tight luminaire that is suitable for installation in open or moist environments, such as parking garages, that maintains a moisture-proof, sealed lower housing for the light-producing lamps (fluorescent lights, LED arrays, etc.) while isolating the electronic components, such as fluorescent ballasts, LED drivers and other devices in a separate, moisture proof upper housing that is spaced apart from, and largely thermally isolated from, the lamps. This isolating arrangement eliminates the cumulative thermal load that will ultimately degrade the efficiency off the luminaire and its associated component life. Likewise, the luminaires internal components (lamp assembly, electronics, etc.) are readily and individually accessible for service, replacement or retrofit by individually accessing each of a plurality of respective housings within the overall luminaire. The lamp housing comprises a unitary tubular lens with one or more removable end caps, sealed by gaskets. The lamp assembly is slidably mounted within the lower housing so that it is readily removable and replaceable with another assembly of the same or different type. The electronics in the upper housing is readily accessible and replaceable by removing a top cover that encloses a three sided channel member. The upper housing is illustratively metal, and desirably enhances heat exchange with the environment. The two housings are held together in a predetermined orientation by a pair of opposing end cap structures that include a housing end structure (that can be cast, machined or otherwise constructed) and a removable end cap. The use of vertically oriented sealing surfaces at each end of the luminaire inherently provides improved sealing capability due to (a) greatly reduced sealing surface area as opposed to traditional horizontally sealed luminaires; (b) greatly reduced spacing between end cap fasteners which create the seal condition, and notably, (c) by providing vertically oriented sealing surfaces that limit the possibility for moisture to migrate into the luminaire as gravity causes moisture to 'drain' off of the luminaire, and not accumulate on and/or seep through the seal.

The housing end includes an upper plate that is fastened against an adjacent end of the upper housing's channel member. This compresses gaskets that stand between the respective ends of the lens and a lower ring on each housing end with a substantially uniform pressure about the entire perimeter, enabling a more reliable and even seal. The electronics of the upper housing is interconnected via a connector to an end connector in on the lamp assembly. The interconnection can reside in a volume defined by a dome in at least one of the end caps, which can be light transmissive. The interconnection can include an interconnecting wiring harness (i.e. a multi-conductor cable) that exits the upper housing through a wire-chase hole in the upper plate of the housing end and reenters the housing end through another wire-chase hole adjacent to the tubular lens, near the lower ring. A removable covering cap with an associated gasket covers the exposed portion of the interconnecting harness where it extends between the upper housing and the lower housing. This covering cap and gasket defines an L-shaped surface that engages against the corresponding L-shaped surfaces of the housing end in the region of the wire-chase holes. A similar covering cap and gasket is located on the opposing housing end as well. This covering cap can be substituted by an accessory, such as an external controller, sensor, or other functional device/feature. The accessory can be located on the housing end that contains the lamp assembly harness, or on the opposing housing end. The wire-chase holes in the housing end that access either (or both) of the housings (upper and/or lower) can be employed to guide an accessory harness that interconnects with electronics contained within the housing(s). The accessory can include an integral cover and associated gasket to seal off the chase holes.

More particularly, a vapor-tight luminaire according to an illustrative can be broadly defined to include a vapor-tight lower housing defining a sealed tubular lens having a pair of end cap structures, with the lower housing removably supporting a lamp assembly. An upper housing is separated from the lower housing along an elongated length thereof between the end cap structures. The upper housing contains electronics for operating the lamp assembly and being interconnected with line current. An interconnecting harness extends along at least one of the end cap structures between the electronics and the lamp assembly. Illustratively, the tubular lens comprises a light-transmitting polymer and the upper housing is at least in part composed of metal. Also, the tubular lens can define a circular, ovular, polygonal or irregular cross section along a plane perpendicular to an axis along the elongated length. In addition, the lamp assembly is slidably mounted with respect to posts on each of the mounting brackets, which can support a rail that is captured by the lamp assembly so that the lamp assembly is removable through an opening when the end cap is removed from the lower housing. The lamp assembly can further include a locking mechanism that selectively engages at least one of the posts and secures the lamp assembly against sliding along the rail. Illustratively, the lamp assembly can include a plurality of fluorescent lamps and associated reflector panels. In an embodiment, there are a pair of side fluorescent lamps and a bottom fluorescent lamp separated by the reflector panels. The electronics in the upper housing in this embodiment includes a fluorescent ballast. Alternatively, the lamp assembly can include another type of lamp (light source), such as array of LEDs, which can illustratively be provided in rows along the elongated length of the assembly. By way of example the LED lamps and light-spreading lenses are provided on a circuit board arrangement with respect to a bottom surface of a heat sink. A top surface of the heat sink is removably mounted to the lower housing via a channel that engages the lower housing's mounting rail. A novel set of up-light LEDs are provided on circuit boards along upwardly angled (e.g. approximately 45-degree to the horizontal) edges of the heat sink. These allow illumination the surrounding area beyond 180 degrees. In this example, the electronics in the upper housing includes an LED driver circuit. The lens can further include fluted sections around its circumference that are located with respect to reflector panels and/or lamps to improve the overall optimetrics. Likewise the lens can include an opaque top section to block light from migrating toward the ceiling. This opaque section can be formed by co-extrusion along with the extruded fluted sections. Other components of the luminaire, such as the top cover, upper housing channel member, rail and lamp assembly frame can also be constructed by extrusion. An optional overlay constructed from a thin material (e.g. a frosted polymer sheet) can be removably located against an interior surface of the lens around at least a portion of a perimeter thereof. The overlay defines a surface that alters the transmission of light through the lens—for example providing a diffusive surface, a perforated surface, a tinted surface, a phosphor, etc.

A novel method is also provided for replacing or retrofitting a lamp assembly in a housing of an illustrative luminaire according to the embodiments generally described above. This method includes the step of providing (a) a vapor-tight lower housing defining a sealed tubular lens having a pair of end cap structures and a lamp assembly contained therein, (b) an upper housing separated from the lower housing along an elongated length thereof between the end cap structures, the upper housing containing electronics for operating the lamp assembly and being interconnected with line current, and (c) an interconnecting harness between the electronics and the lamp assembly. The further step of removing an end cap from one of the end cap structures to define an end opening in the lower housing is also provided. The lamp assembly is disconnected from the interconnecting harness and the lamp assembly is slid through the end opening and out of the lower housing. A replacement lamp assembly is then slid through the end opening and into a final position therein. The interconnecting harness is connected to the end connector, and the end cap is attached to the one of the end cap structures to form a vapor-tight seal at the lower housing. In a further step, where appropriate, the upper housing is accessed, typically through the top cover, and the electronics is replaced, so that the replacement electronics can be used drive the replacement lamp assembly. The replacement can be the same type of lamp as the original (e.g. fluorescent-to-fluorescent) or a different type of lamp (e.g. fluorescent-to-LED, or vice versa).

BRIEF DESCRIPTION OF THE DRAWINGS

The invention description below refers to the accompanying drawings, of which.

DETAILED DESCRIPTION

I. Structural Overview

Figure 1:
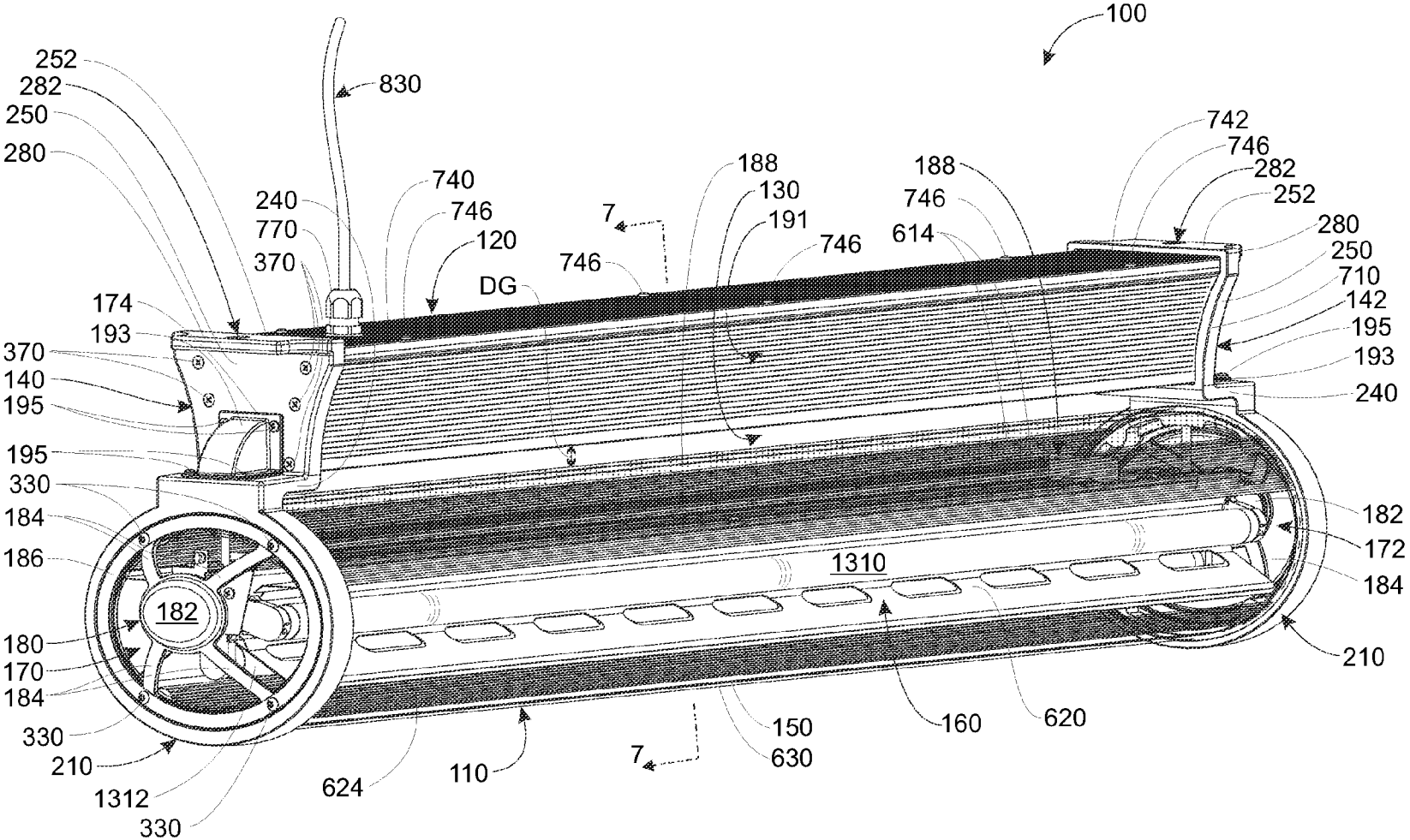
FIG. 1 is a perspective view of a vapor-tight luminaire according to an illustrative embodiment employing three fluorescent lamps in a reflector assembly.
Figure 3:
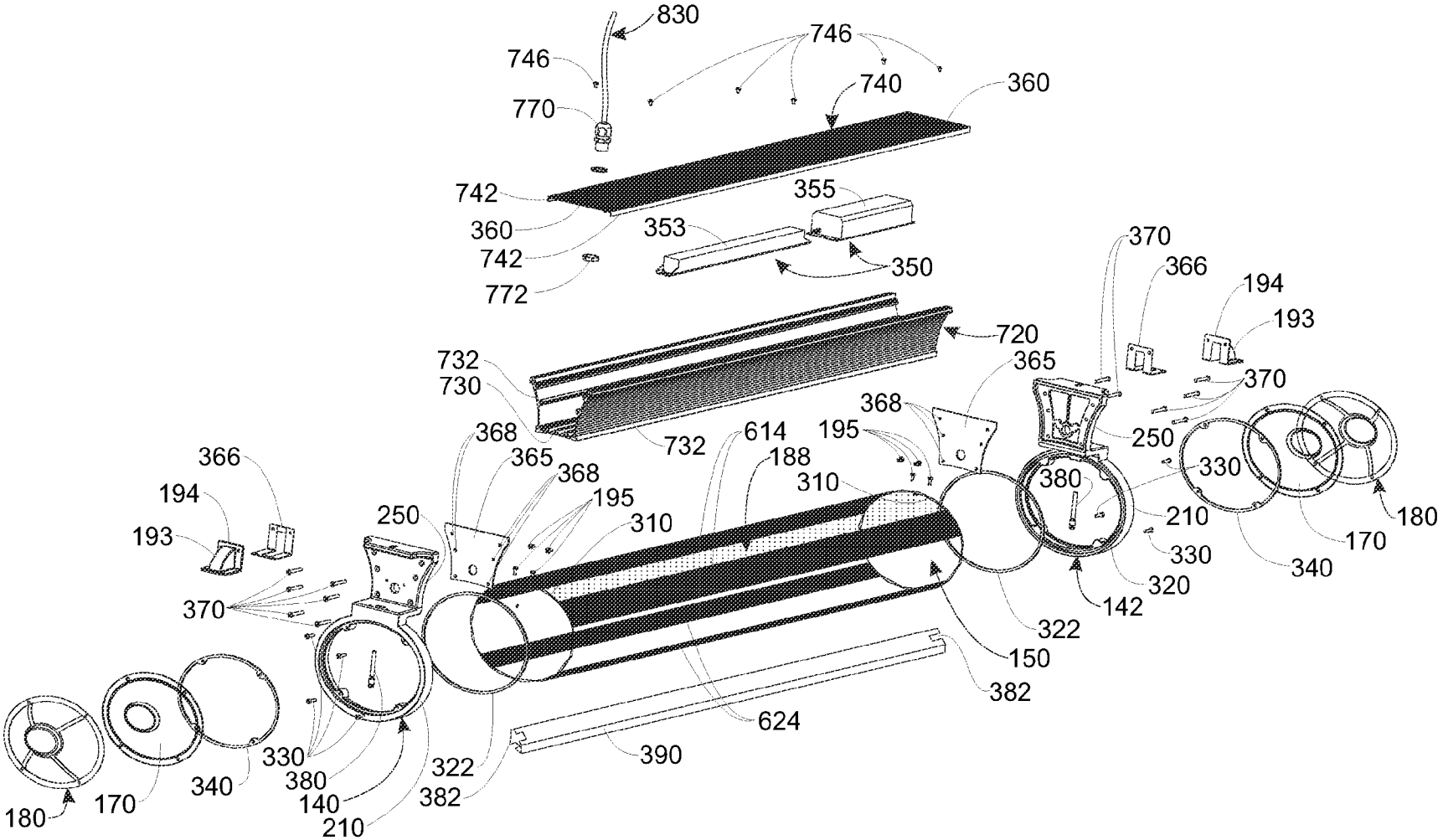
FIG. 3 is an exploded perspective view of the housing elements of the luminaire of FIG. 1 with the reflector and lamp assembly removed and omitted.

A luminaire (light fixture) according to an illustrative embodiment is shown in assembled form in FIG. 1 and in exploded view (with reflector and lamp assembly omitted) in FIG. 3. This novel luminaire 100 includes a main light source housing 110 (also termed "main housing" or "lower housing") and an electronics and/or ballast housing 120 (also termed "upper housing") that is suspended above and separated from the main housing 110 with a gap or airspace 130 that runs the length of each housing between opposing housing end structures (or "housing ends") 140 and 142. The housing ends 140, 142, maintain the alignment between the upper and lower housings and provide the units overall structural integrity as described further below. Illustratively, the gap 130 has a vertical distance DG between the confronting housing surfaces of approximately ¼ to 1½ inches. Other gap distances are expressly contemplated. The gap is generally small enough to prevent wildlife (birds, rodents, etc) from building seats above the lower housing, which can be a particular concern where the housing includes warm-running lamps, such as LEDs or incandescents. Nests can be a significant fire hazard in such instances and reduce the heat-transfer efficiency of the lower housing. The gap 130 can comprise air or any other appropriate insulating material so as to separate the upper housing 120 from the lower housing 110. The gap 130 can be defined substantially along the entire length between each housing, or can include non-penetrating spacers or non-penetrating brackets that separate the upper housing 120 from the lower housing 110 without penetrating the lens 150. In general, it is desirable to avoid penetrating the lens along its length so as to avoid eventual and inevitable degradation/failure of a seal around a penetration, which leads to loss of vapor-tightness.

Note that directional terms such as "upper", "lower", "top", "bottom", "vertical", "horizontal", "right", "left", and the like, should be taken as relative directions only, and with reference to the depictions in the figures, rather than as absolute directions with respect to the orientation of gravity.

The main lamp/reflector housing 110 and the electronics housing 120 are collectively secured together by the two housing ends 140 that allow for the continuous gap 130 along the length of each housing 110, 120 by carrying the structural load of the overall luminaire 100 and maintaining the parallel alignment of the two housings. The left housing end 140 (the right housing end 142 being a mirror image) is shown in further detail with reference also to FIGS. 2 and 2A. Each housing end 140, 142 can be constructed from a durable material as a molded part, machined part or casting (or using another acceptable construction technique). In an embodiment the housing ends 140, 142 are constructed from cast or forged aluminum alloy, but can be constructed from another metal, a durable polymer or a composite (e.g. glass filled nylon, fiberglass, carbon-fiber, etc.). Appropriate machining can be used to provide the final shape and fitting bases (e.g. screw/bolt holes). As shown, the housing end 140 includes a lower ring 210 having a size and shape (ovular in this embodiment) that is adapted to fit over the end (310 in FIG. 3) of the translucent, tubular lens 150 of the main housing 110. The housing ends' (140, 142) ring section 210 defines an outer rim with an inner well (320 in FIG. 3) that snugly engages and captures the end 310 of the lens 150. A gasket 322 is illustratively provided within the well 320 in FIG. 3 at the interface between the lower ring's well 320 and the end 310 of the lens 150 to ensure a vapor-tight fit. The gasket can be constructed from a variety of durable, long-lived elastomers. Illustratively, it is constructed from a urethane foam (for example, Poron 4701-41 available from Rogers Corporation having a durometer of 24 and a density of 20) with gasket thickness of 0.125 inch (⅛ inch). As described further below, the cross section of the lens/main housing defines a generally ovular shape with a major axis oriented in the horizontal direction and the minor axis oriented in the vertical direction. The dimensions of each axis are highly variable, and are more generally chosen to provide appropriate clearance for the desired reflector and lamp assembly contained within the main housing. One such reflector and lamp assembly is the illustrative three-lamp assembly 160 depicted in FIG. 1 (and described further below). Note that the term "reflector and lamp assembly" can also be termed herein as a "lamp assembly" so as to include cases (but not be limited to) where lamps are arranged without need of reflectors.

In an embodiment, the lens 150 has a length of approximately 46.8 inches. However the length of the lens can vary in alternate embodiments. This length, along with the additional clearance provided by each housing end 140, 142, allows for the mounting of a conventional tubular fluorescent lamp in the reflector and lamp assembly 160, such as the standard 48-inch, bi-pin, T-8 fluorescent lamp with 2900-lumen average output. Other lamp types are expressly contemplated, as described further below.

Notably, the structure of the main housing 110 makes possible a highly variable cross sectional shape and size for the lens and associated components, as the structure does not rely upon a mating top and bottom clamshell arrangement as taught in the prior art. Rather, the main housing 110 and associated lens can be formed in any acceptable shape, including, circular, curvilinear, polygonal (regular or irregular), and a combination of curvilinear and polygonal (for example, substantially flat sides and an arched top and/or bottom). This is because the housing ends can support and engage the ends of a continuous, tubular lens with any form of cross sectional shape by forming each housing end's lower ring section appropriately to seat over an adjacent end of the lens. Any shape is expressly contemplated that provides a unitary tubular lens of any given cross-section and that is continuous and unbroken along its entire length so as to provide an effective seal. Moreover, the use of an elongated lens that is generally free of penetrations along its length, and an associated upper housing that does not rely on interconnections with the lens between the housing ends allows for variable-length sizing of the unit. For example, while a four-foot unit is shown in the embodiments herein, a three-foot unit, two-foot unit or one-foot unit (among other sizes) can be provided by shortening the upper housing channel member and lower housing lens. This can allow for use of the housing with shortened lamp assemblies (e.g. shorter fluorescent lamps, LED assemblies, etc.). The use of shorter or longer units can be desirable to enhance the versatility of the overall lighting system. By way of example, and as described below, the luminaire can be mounted vertically, and in certain installations a shorter version can be desirable for use as a wall sconce.

As shown, each housing end's (140, 142) lower ring section 210 is covered by a respective external, sealing end cap 170 and 172. In this embodiment each end cap 170, 172 (described further below) comprises a dome shape, with an outer perimeter edge that seats into a well 220 that is recessed within the perimeter of the housing end's lower ring section 210. The well 220 illustratively includes four inwardly bulged bases 230, each with a threaded hole 232 of appropriate size to receive a machine screw 330 (see FIG. 3) that is used to selectively hold down a portion of the end cap 170, 172. The end caps 170, 172 are each secured into the well by compression force applied by the tightened hold-down screws 330, which pass through holes (410 in FIG. 4) the end cap's outer flange ring (186) and into the aligned bracket holes 232. The well can include a gasket 340 (FIG. 3) formed from an appropriate material such as rubber, silicone, or urethane (Poron 4701-41, for example) with an illustrative thickness of approximately 0.125 inch (⅛ inch), so as to provide the desired vapor-tight seal. As shown the gasket 340 is cut to overlie the screw bases 230, and includes conforming screw holes. The seating of the gasket 340 in alignment with the housing end's (140) screw holes 232 is depicted further in FIG. 2. In an embodiment, the gasket 340 can include an adhesive that fixes it in the well 220.

Figure 4:
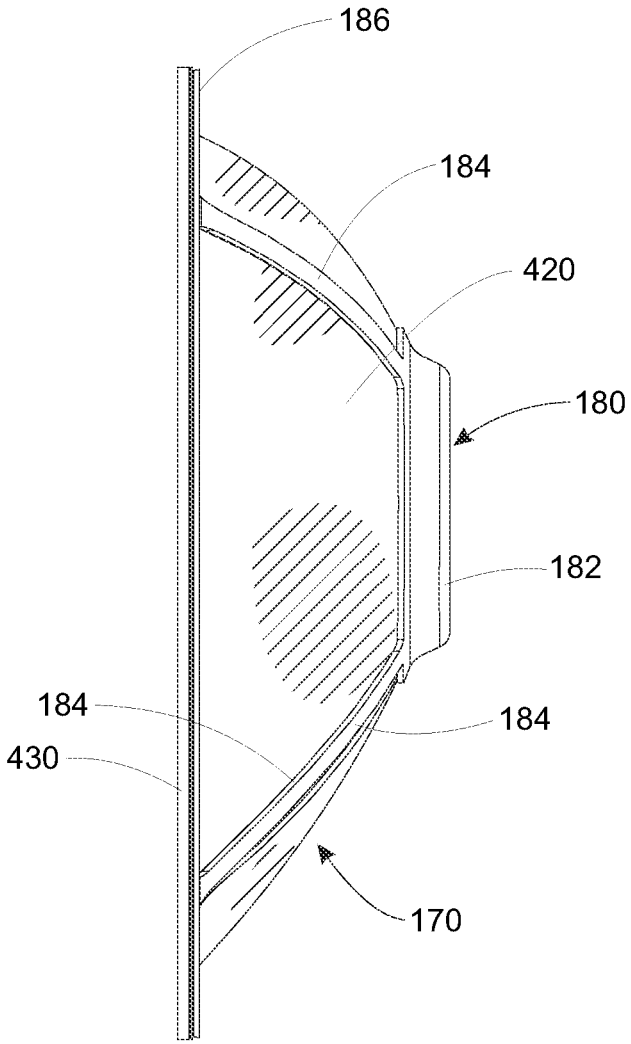
FIG. 4 is a side view of an illustrative end cap, including a translucent dome-shaped sealing cap and overlying bezel for use with the luminaire of FIG. 1.
Figure 5:
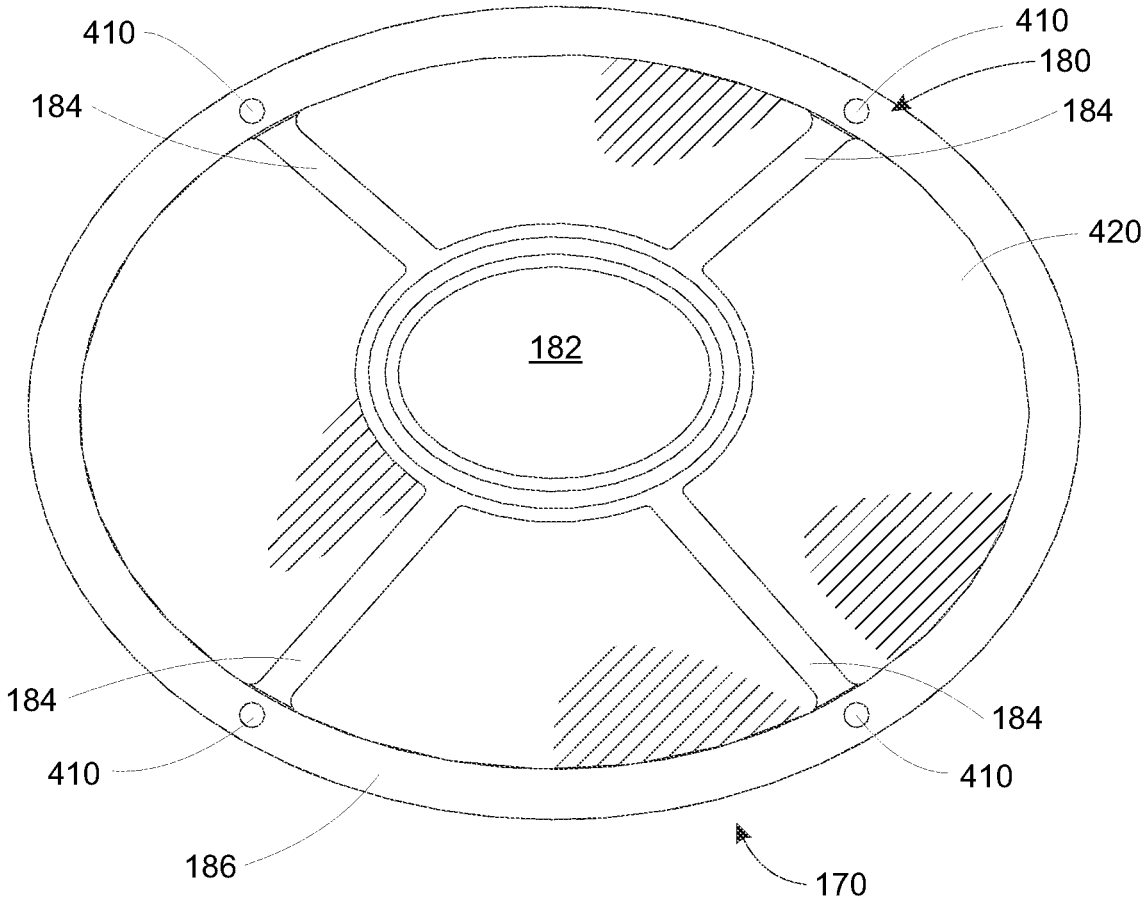
FIG. 5 is a frontal view of the end cap of FIG. 4.

Further reference is made to FIGS. 4 and 5 which show the end cap 170 (end cap 172 being a mirror image) in further detail. In an illustrative embodiment the end caps 170, 172 are provided as transparent or translucent domes 420 having a separate outer bezel 180 with a center hub 182 and four spokes 184 that extend to an outer ring 186. The bezel 180 is provides a protective and reinforcing function with respect to the underlying dome 420 in various embodiments. That is, where the dome's material may be prone to deformation and/or cracking, the bezel provides a reinforcing rib/cage structure to resist such deformation. The bezel also provides an interesting and decorative design feature. The bezel 180 can define a different shape or configuration (number of spokes, center hub size, etc.), or can be omitted in alternate embodiments, and the transparent/translucent dome (or another end cap of any appropriate shape) can be employed as a standalone end cap unit. In this embodiment the bezel 180 is constructed from stamped (or cast) steel or aluminum having an appropriate surface finish (e.g. metal-plated, polished, painted, dyed, etc.). Other appropriate materials can be used to construct the bezel in alternate embodiments including, but not limited to, another metal, composite, durable polymer or combination of such materials. The transparent/translucent dome 420 further includes a unitarily molded, flat base ring 430 at its outer perimeter that underlies the bezel's outer ring 186, and through which the hold-down screws 330 pass via holes 410 that align with the holes 232 in each housing end 140, 142. As shown in FIG. 1, this base ring 430 engages and compresses the gasket 340, and seals against the face of the well 220 in the housing end ring section 210.

The bezel's outer ring 186 provides further rigidity stability to the overall end cap assembly and ensures that the force exerted by the screws 330 is spread over the translucent dome's base ring 430 so as to avoid stress concentrations and assure that a more-even sealing pressure is applied to the underlying gasket 340. In alternate embodiments, the bezel can be all or partially omitted and the base ring of the dome can be reinforced by other forms (and/or geometries) of structures. These alternate reinforcing structures can be applied to, or integral with, the dome's base ring. Additionally, optional O-rings or other elastomeric washers (not shown) can be positioned between the heads of screws 330 and the outer ring 186. These O-rings cushion the applied force of the screws so as to prevent cracking of the dome's base ring in the event that the screws 330 are slightly over-torqued.

The sealing portions of the end caps 170, 172 (i.e. the domes 420) can be illustratively constructed in whole or part from any acceptable material with sufficient durability, service life and structural strength—for example, acrylic. However, other transparent, translucent or opaque materials, such as polycarbonate, steel, aluminum, composite (or a combination of such materials) can be used in alternate embodiments. In an embodiment, the transparent/translucent domes 420 have a thickness of approximately 0.09 inch. Different thicknesses are contemplated depending upon the material, and other decorative/structural considerations. The dome 420 is constructed by molding, but other forming processes are expressly contemplated, such as thermoforming. Each end cap 170, 172 projects outwardly approximately 1.5-1.75 inches from the adjacent housing end ring section 210, thereby providing additional clearance within the ends of the main housing 110 for electrical connections and other structures (as described further below).

Note, however, that the end caps 170, 172 can be formed in any appropriate shape, and the use of a dome shape is only illustrative. Flattened shapes, pyramidal shapes, conical shapes or rectilinear shapes can also be employed, among others. In general, the end cap should be shaped so as to provide sufficient internal clearance for elements of the reflector and lamp assembly (e.g. its electrical connections). Likewise, while the end cap 170, 172 is depicted as transparent or translucent, it can be entirely (or partially) opaque or specular in alternate embodiments. Alternatively, it can be fully or partially translucent in a contrasting color or tint relative to the main housing lens 150 (green tint, for example). Also, while four hold-down screws 330 are employed to removably secure each end cap 170, 172, the number and placement of screws is highly variable in alternate embodiments. It is expressly contemplated that alternate types of fastening mechanism can be used to secure each end cap to its associated housing end—for example a plurality of clamps located around the perimeter of the housing. Thus, as used herein, the term "fastener", can be taken broadly in this and other applications to include alternate mechanisms that removably and sealably secure the end caps to the housing ends. It is also expressly contemplated that the end caps can be radiators, fans, or any other radiative structure that allows for transfer of heat from the interior of the housing 110 to the exterior thereof.

Figure 6:
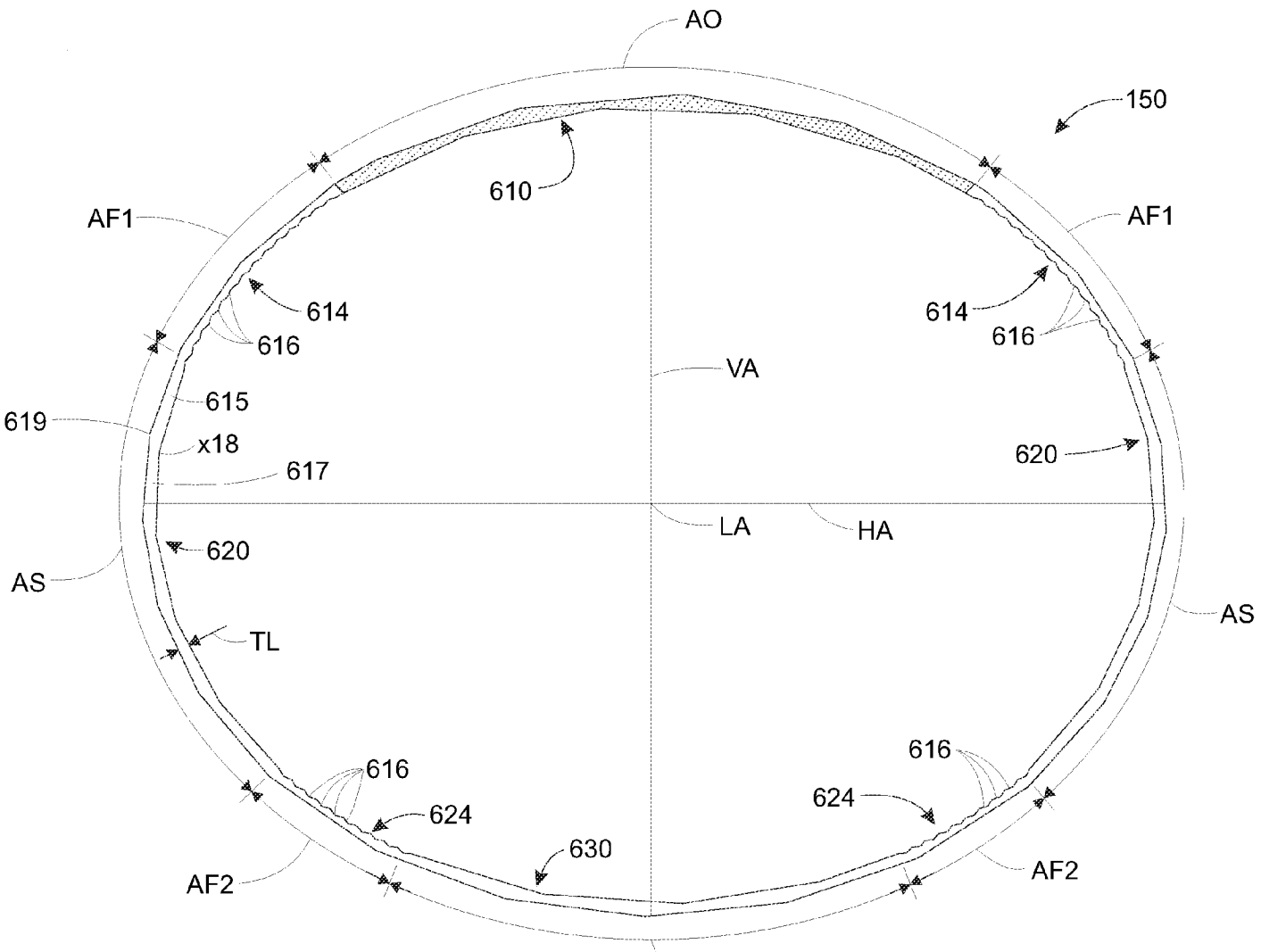
FIG. 6 is a side view section of the lens of the luminaire of FIG. 1 detailing the cross sectional geometry thereof.

Reference is now also made to FIG. 6, which details the side/cross-sectional profile of the main housing's lens 150 in accordance with an illustrative embodiment. The lens 150 is constructed of a transparent and/or translucent material, such as acrylic or polycarbonate. In an illustrative embodiment, the lens 150 can be constructed as an extrusion, which ensures a vapor-tight enclosure along its length (with the lens defining, in essence, a pipe). Any structure for the lens 150 is expressly contemplated that has a perimeter that is free of any gaps or other breaks along its length, so as to provide a lens that is continuous and unbroken about its perimeter and along its length between the ends caps. This continuous and unbroken lens maximizes the seal by the gaskets between the end caps and the lens and further ensures that the only sealing mechanism needed is at the end caps. As described below, the internal and/or external surface of the lens 150 can include a variety of light-refracting structures to diffuse and distribute the transmitted light from the enclosed reflector and lamp assembly 160. An arc (relative to the longitudinal axis LA) of approximately 90 degrees of the lens (45 degrees on each side of the vertical axis) along the top comprises a shield 188 (shown as a dot-shaded region for clarity) that is generally opaque, and prevents stray light from projecting toward the ceiling, and more generally aids in preventing an undesirable hot spot of light directly over the luminaire. This shield 188 can be constructed by co-extruding an opaque version of the lens material—for example a dyed or pigment-filled polymer. Alternatively, the shield can be constructed by applying paint or an appliqué to the lens, or the shield can be a solid plate that is mounted against the interior or exterior the lens 150. Note, in alternate embodiment the unitary or applied shield can be omitted, and/or a discrete clear/translucent lens section can be provided in the region of the upper side of the lens.

With further reference to FIG. 6, the lens' structure and associated features in this embodiment are adapted for ease of extrusion, and thus include features that run parallel with respect to the longitudinal axis LA—i.e. the direction of extrusion through an extrusion die. In this embodiment, the lens is constructed with a wall thickness TL of approximately 0.06-0.13 inch. However, a variety of thickness dimensions, as well as a varying thickness around the lens perimeter can be employed. Notably, the lens 150 is divided into various segments about the perimeter that are associated with the locations of reflectors and lamps, and designed to enhance optimetrics. As described above, the top segment 610 defines an arc angle AO of approximately 90 degrees, centered about the vertical axis VA (minor axis of the oval). This section is coextruded with the rest of the lens 150 using an opaque-colored material in an illustrative embodiment. The color is highly variable, but desirably absorbs light—for example, black or grey.

The adjacent top segments 614 of the lens 150 are fluted, using a series of 1-degree (normal to the lens inner surface), 0.02 inch linear groove features 616 that extend parallel to the longitudinal axis LA. The geometry of these light-bending/diffusive features is highly variable in alternate embodiments. In general they are adapted to provide an appropriately diffuse light and a general prismatic effect at high angles with respect to the vertical VA. The top fluted segments 616 define an arc angle AF1 of approximately 29 degrees with respect to the longitudinal axis LA.

Note that, in this embodiment, the overall perimeter lens (fluted, unfluted and opaque segments) is generally composed of a series of interconnected, approximately planar segments (facets) that join at inner and outer offset corners (for example segments 615 and 617 and corners 618 and 619). This geometry provides an interesting effect and lens appearance, but is optional. Alternatively, the lens can comprise a continuously curved perimeter wall, among other geometries.

The opposing sides of the lens define a clear, unfluted segment 620 through which the horizontal axis HA (major axis of the oval) passes. The clear sides 620 define an arc angle AS of approximately 51 degrees. The clear sides 620 allow for relatively full transmission of light from the adjacent reflector and lamps.

The lens also includes two narrower, bottom fluted segments 624, each located on an opposing side of the vertical axis VA. This segment is located relatively adjacent to the outer edge of each side of the bottom reflector assembly 1392 (described below with reference to FIGS. 13-15) so as to spread more light in this region from the bottom lamp 1312. These fluted segments 624 each define an arc angle AF2 of approximately 20 degrees. A bottom clear segment 630 of the lens 150 is located across the vertical axis VA, and defines an arc angle AB of approximately 70 degrees. In this embodiment, the vertical axis VA is approximately 6.6 inches and the horizontal axis HA is approximately 8.25 inches. It should be noted that the lens dimensions, as well as the dimensions of all segments, their number and their placement on the perimeter of the lens (the "lens feature parameters") are all highly variable in alternate embodiments. These feature parameters are dependent in part on the desired optimetrics, and taking into account the number, output and type of lamps employed, as well as the placement of reflectors surrounding the lamps. Thus, for alternate embodiments described further below, the lens feature parameters, as well as the lens cross sectional shape and dimensions, can vary to suit the particular reflector and lamp assembly described in that embodiment. Likewise, it is expressly contemplated that one or both sides of the lens can include a frosted or otherwise diffusing surface along all or a portion of the lens. This can be achieved by etching or media-blasting the associated lens surface. In an illustrative embodiment, the lens is particularly constructed of medium-impact acrylic, and the clear sections allow for approximately 92 percent light transmission while the fluted sections allow for approximately 89 percent light transmission. While extrusion is a desirable lens-formation technique, in alternate embodiments, the lens 150 can be constructed from a formed piece of sheet material that is, for example, wrapped around a mandrel or former, and welded at a seam. Other possible techniques for constructing a tubular lens of this kind should be clear to those of ordinary skill—for example, injection molding or casting.

Figure 2:
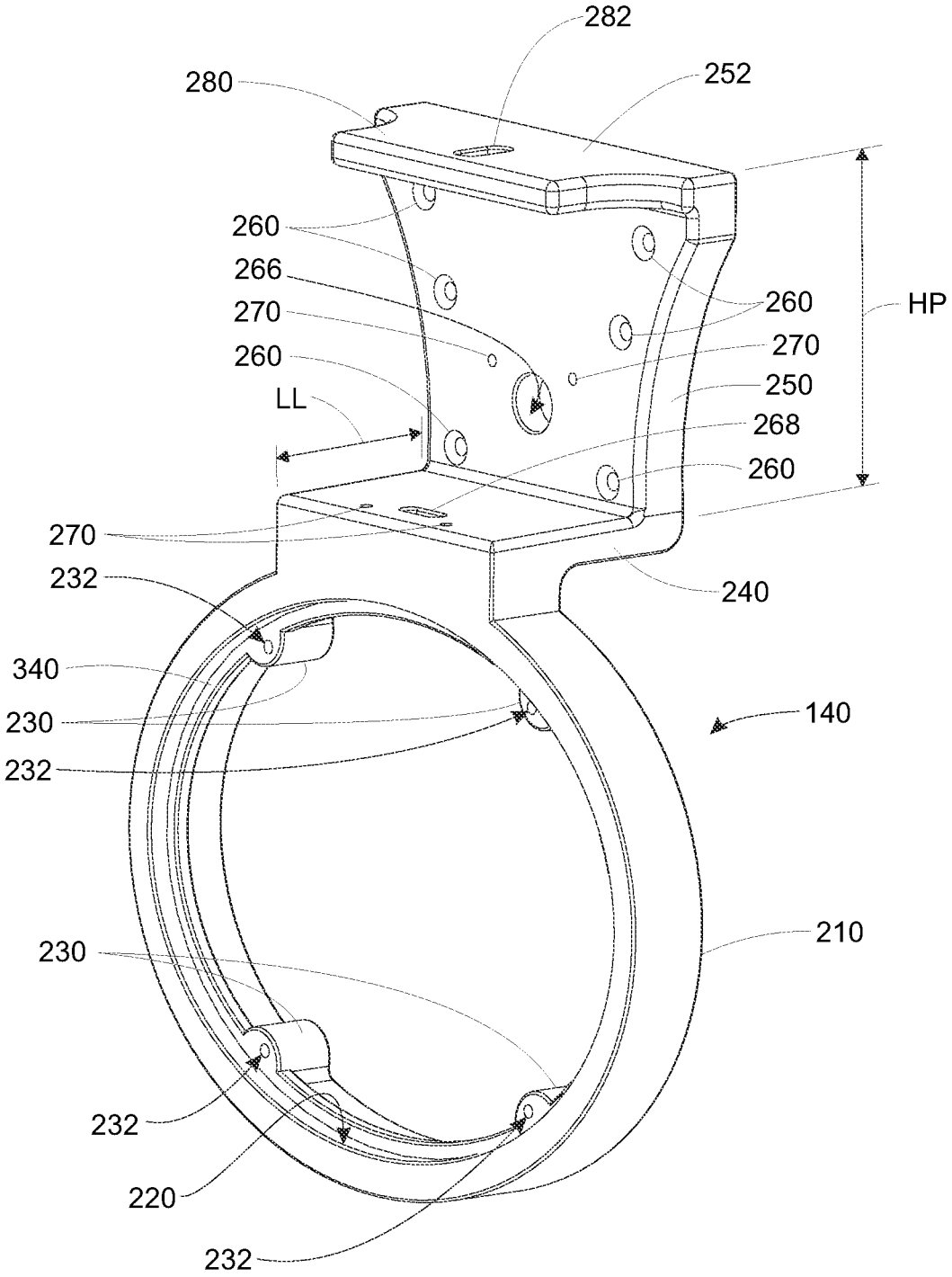
FIG. 2 is a frontal perspective view of a housing end structure for joining the upper and lower housing sections of the luminaire of FIG. 1.
Figure 2A:
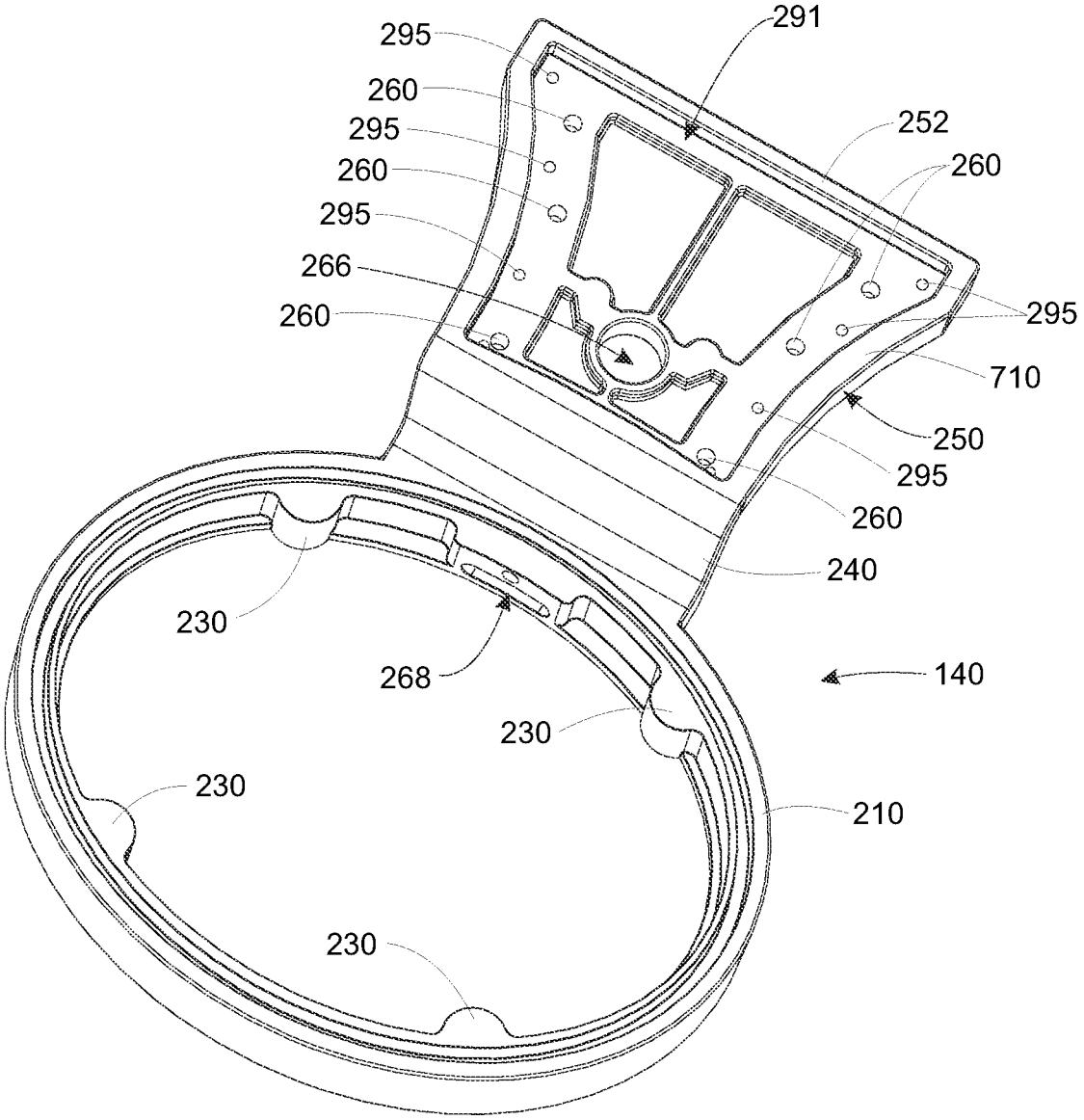
FIG. 2A is a rearward perspective view of the housing end of FIG. 2.

With reference particularly to FIG. 2, the housing end 140 is shown in further detail. The description thereof also applies to the opposing housing end 142, which is the same structure, but mounted in a reversed position on luminaire 100. Each housing end 140, 142 comprises a unitary structure that can be formed from a casting (for example, cast A380 aluminum alloy). It can be constructed from alternate materials (e.g. metals, polymers, composites or combinations thereof) using appropriate manufacturing techniques known to those of skill in the art (e.g. machining, injection-molding, etc). The housing end 140 includes an inwardly directed leg 240 above the ring 210 having a length LL of between approximately 1 and 2 inches in an illustrative embodiment. The inward end of the leg 240 is joined to a vertical end plate 250 having a somewhat upwardly flared (concave-curved-V) shape that terminates at the top end 252. This shape is in part decorative and other shapes can be provided in alternate embodiments. The vertical end plate 250 provides an encapsulating end cap for the upper/electronics housing 120. The vertical dimension (height HP) of this plate 250 is approximately 3.75-4.5 inches. It varies from a width at the bottom of approximately 3.0 inches to 3.75 inches to a width of approximately 5.0-6.0 inches at the top. These dimensions are only illustrative, and are sized and arranged to provide sufficient clearance for the electronics package 350 that is housed in the upper housing 120.

Notably, the mating surfaces on each housing end (i.e. with the upper housing's channel member, lower housing's lens, end caps and part of the covering cap 193), are all substantially vertical when the luminaire is mounted in a standard horizontal configuration. This ensures that substantially all sealing surfaces are substantially vertical, thereby enhancing the drainage of moisture from these seals and minimizing the pooling of moisture that can eventually migrate through a seal. In various embodiments, the one non-vertical sealing surface, between the cap 193 and housing end leg segment 240, can be beveled (as an option), or otherwise shaped to prevent pooling of water on the housing end leg 240 near the cap gasket 366.

Figure 7:
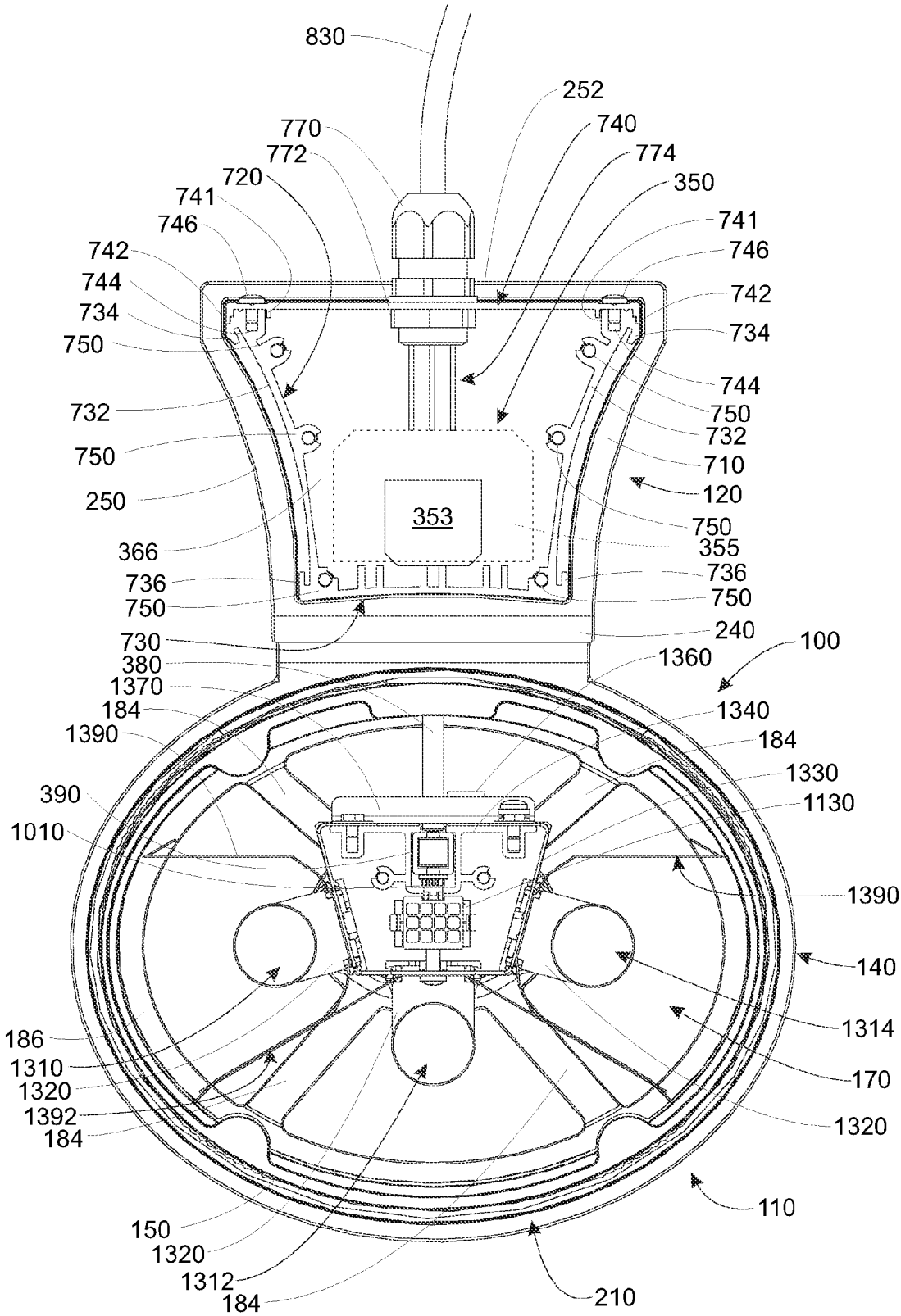
FIG. 7 is a side cross section of the luminaire taken along line 7-7 of FIG. 1.

With reference to the cross section of FIG. 7, each vertical end plate 250 provides an inner-facing well with an outer rim 710 into which a three-sided channel member 720 is seated. This channel member 720 provides the primary elongated enclosure for the upper housing 120. In cross section, the channel member 720 generally defines the concave-curved-V shape, described above, but other cross-sectional shapes are expressly contemplated. This shape conforms relatively closely to that of the rim 710. The rim 710 surrounds all four sides of the channel member 720, thereby capturing it and eliminating any lateral motion between the channel member 720 and each housing end 140, 142. The channel member 720 in this embodiment is an aluminum extrusion constructed, illustratively, from 6063 alloy. However, the channel member 720 can be formed using appropriate manufacturing methods from a variety of other metals, polymers or composite materials (or combinations thereof) in alternate embodiments. As described further below, the channel member 720 includes a bottom side 730, and a pair of side walls 732. Notably, the sidewalls contain an elongated top shoulder 734 and bottom shoulder 736, that are used to restrain an optional trim panel (191 in FIG. 1) having a predetermined pattern and/or color (such as the name of the installed location, or manufacturer). The trim panel can be constructed from any relatively thin and flexible material, and is mounted by sliding it from one side when a housing end 140 and/or 142 is detached from the channel member 720. Alternately a trim panel (191) can be attached by flexing it so that it seats within the opposing shoulders, and then allowing it to expand to lock in place. As described above, the trim panel and the associated shoulders 734, 736 are an optional feature. Moreover, the bottom shoulder 736 can be sized and arranged with a minimal height so as to avoid excess build up of moisture within its well. Slotted drains or scuppers can also be formed at predetermined intervals along the length of the bottom shoulder 736 to facilitate drainage of excess moisture.

The open top of the channel member 720 is covered with a removable top cover plate 740, that can be constructed from extruded aluminum, or another acceptable material in an appropriate thickness (for example, from 0.05-0.1 inch). The top cover plate 740 includes inner and outer skirts, 741 and 742 respectively, which surround a trough 744 that runs the length of each opposing top edge of the channel member 720. These skirts 741, 742 ensure that the top cover plate 740 is well-sealed against moisture infiltration with respect to the channel member 720. The trough 744 receives self-tapping screws (of any acceptable type) 746. The screws 746 pass through holes in the top cover plate 740, and into the trough 744, where their threads are captured and retained. The use of a trough allows placement of a varying number of screws at appropriate locations along the length of the housing 120. In an embodiment, six screws 746 (three per side are sufficient to ensure a secure fit and seal. When mounted, the opposing ends (360 in FIG. 3) of the top cover plate 740 reside beneath the top sides of (adjacent top edge 252) of the housing end's rim 710 to ensure a complete seal. The overall length (in the elongated direction) of the top cover plate 740 is selected so that, when the top cover plate 740 can be completely slid against one housing end (with the end riding under the rim, the opposing end 360 is clear of the adjacent rim, thereby allowing the top cover plate 740 to be levered into and out of engagement with the channel member 720. The top cover plate is brought to a neutral position, residing under both opposing rims 710 to secure it in place. In this position each end is at a partial standoff from the wall of the respective housing end 140, 142 with the gasket (described below) bearing on each edge of the top cover to complete the seal.

In an embodiment, the side panels 732 and/or top cover plate 740 can include elongated fins or other heat-exchanging structures that facilitate transfer of heat by radiation and convection from the upper housing's interior to the outside environment. Likewise, the top cover can be alternatively provided as a multi-section structure (not shown). This can be used to allow access to part of the housing without requiring removal of the entire top cover. An appropriate sealing structure and/or gasket can be provided between cover section joints and the fasteners can be arranged to provide sufficient hold-down pressure to each cover section.

To provide the seal between the housing ends 140, 142, channel member 720 and top cover plate 740 a pair of opposing gaskets 365 (constructed for example from Poron or another elastomer) are provided. The gasket 365 is sized and arranged to seat snugly within the well defined by the rim 710. It has a thickness of approximately ⅛ inch in an illustrative embodiment, but this dimension is highly variable. The gasket 365 includes a series of through-holes that are aligned with countersunk screw holes 260 (FIG. 2) in the vertical end plate 250. These allow the vertical end plate 250 on each housing end 140, 142 to be securely fastened to a respective semi-circular screw receiver 750 using respective self-tapping screws 370 (FIG. 3). Each screw receiver 750 is an elongated channel that runs the length of the inner surface of the channel member 720. Each screw receiver 750 defines a central hole with an elongated cutout at the inner most edge to sufficiently surround and capture the screw, while providing a readily extruded shape. The elongated cutout slot is employed to provide clearance for the extrusion die to form the central hole feature. It should be clear that a variety of alternate fastening mechanisms, such as clamps, can be provided to secure each housing end 140 to the channel member 720 in alternate embodiments.

The vertical plate 250 also includes a through-hole 266 which aligns with a similar hole in the gasket 365. This hole 266 provides a passage for a wiring harness (i.e. a multi-conductor cable—shown as harness 1110 in FIG. 11) that electrically connects the upper housing 120 to the lower housing 110. The harness (1110) passes through a slotted hole 268 in the horizontal leg 240 of the housing end 140 (and/or 142), and exits at the inner top edge of the housing end ring section 210.

The inward recess provided by each housing end's horizontal leg 240 serves a plurality of purposes. One purpose is to provide the run for the main lamp harness (1110) in this embodiment. The harness is covered by a cast, stamped or molded cap 193 that includes a right-angle base 194. In an embodiment, the base is secured to the L-shape formed between the exterior faces of the leg 240 and plate 250 of the housing end 140, 142. The cap 193 includes sufficient interior clearance for an appropriately sized harness and it covers both holes 266 and 268. In an embodiment, the cap 193 is constructed from stamped aluminum alloy having a thickness of approximately 0.03-0.04 inch. In another embodiment, the cap is cast aluminum with an approximate thickness of ⅛-3⁄16 inch. However, other materials and relative dimensions can be employed in alternate embodiments (e.g. composite or injection-molded polymer). An L-shaped gasket 366 (FIG. 3) overlaps the cap base 194 and is sandwiched between the cap 193 and the faces of the housing end 140, 142. This gasket can also be formed from Poron, having a thickness of approximately 0.04 inch. A differing elastomer and/or thickness can be used to form the gasket 366 in alternate embodiments. In this embodiment, the gasket includes an internal slot or hole on each face of its L-shape to allow passage of the harness therethrough. The cap is illustratively secured with four screws 195 that pass through the base 194 and gasket 366, into receiving holes 270 in the housing end 140, 142. Two of the holes/screws (270/195) are located along the vertical face and two of the holes/screws are located on the horizontal face of the cap base 194. Again, an alternate arrangement of fasteners and/or an alternate mechanism for covering the harness as it passes between the two housings 110, 120 can be employed in alternate embodiments. For example, a flexible, sealed conduit can be provided directly between the lens 150 and the channel member 720 in an alternate embodiment. Alternatively, an integral set of leads can be integrally constructed on or within the housing end(s) 140 and/or 142 with appropriate connectors and/or electrical leads extending from the housing end(s) into each housing.

Figure 8:
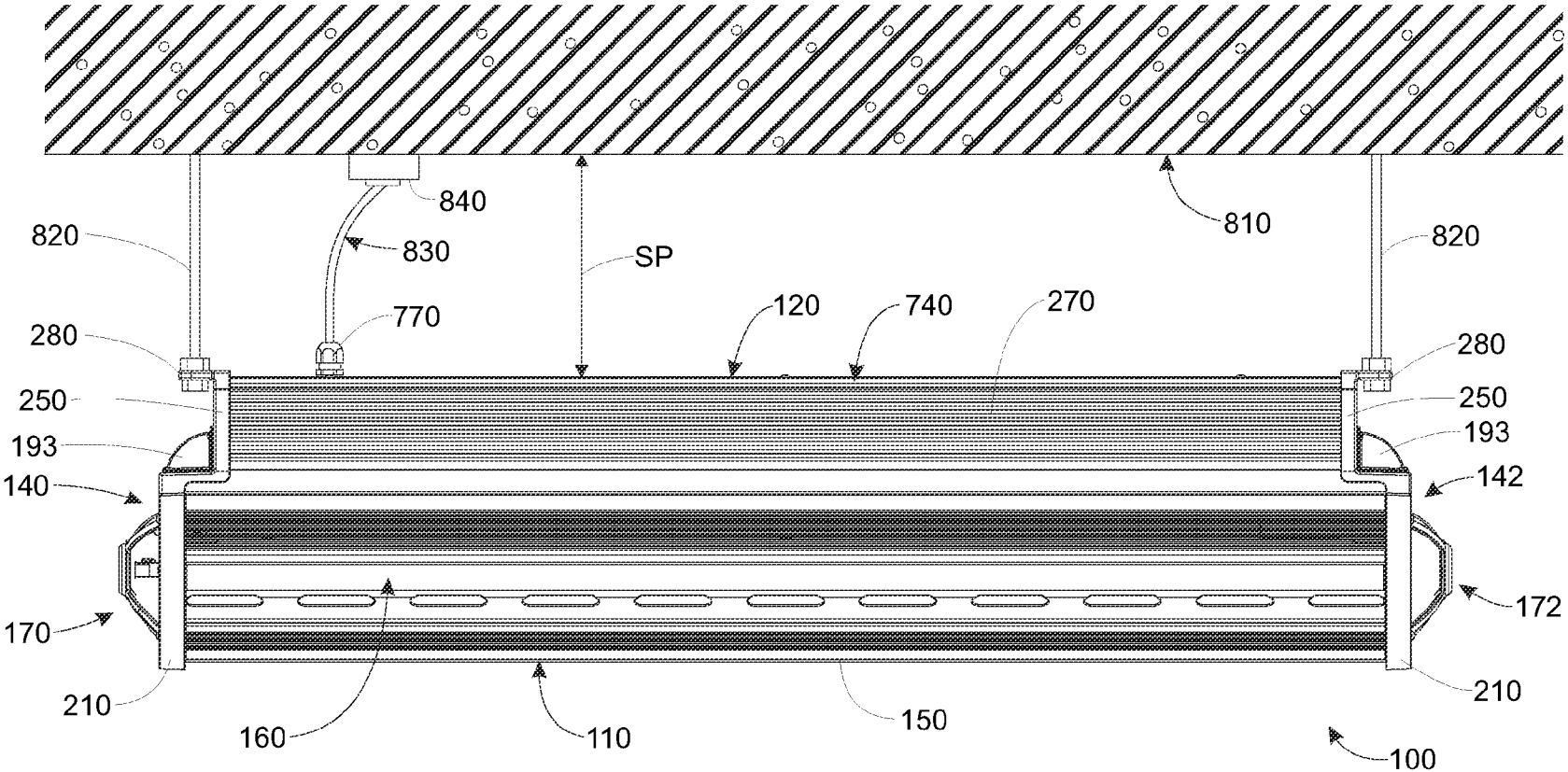
FIG. 8 is a side view of the luminaire of FIG. 1 shown mounted to a ceiling surface via posts or stanchions.

Another function of the inwardly directed leg 240 is to provide a clearance for an outwardly extended mounting base 280 at the top of each housing end 270 that overhangs the leg 240. This base 280 includes a through hole 282 that is sized to receive a post or bolt for mounting the luminaire 100 in a pendant orientation from a ceiling or other overhead structure. As shown in FIG. 8, the luminaire 100 is supported below a ceiling surface 810 in a structure such as an indoor parking facility at a spacing SP of between several inches and several feet. Support for the luminaire 100 is provided by a pair of posts 820 that include threaded ends (or are alternatively threaded along all or a substantial portion of their respective lengths), that engage the respective through holes (182) in each of the bases 280. Nuts or other securing structures can be provided above and below the base 280 to restrain lateral movement of the luminaire along each post 820. The posts are anchored in the ceiling 810 or other structure using conventional techniques. The bases 280, due to their overhang provide an accessible and convenient location for attachment to the posts 820 and subsequent adjustment. Notably, the placement of the bases allows the region overlying the top cover 740 to be free of any ceiling brackets or other mounting structures, thereby allowing for straightforward attachment and detachment of top cover while the luminaire 100 remains installed on the ceiling or other supporting structure. The positioning of the bases 280 more generally aids in initial installation, and subsequent replacement of a luminaire according to the illustrative embodiment.

In this embodiment, the electronics provided in the upper housing 120 are electrically connected with an external power source (e.g. line current at 120-277 VAC) via an external power feed (i.e. a multi-conductor cable) 830. With reference also to FIG. 7, the power feed is sealed to the top cover 740 using a conventional sealing nut assembly 770 that passes through the top cover 740. The sealing nut assembly is locked in place, in a sealed relationship (with appropriate seals and gaskets) using a locking nut 772, which engages the inner facing side of the top cover 740. The opposing end of the power feed is connected to the structure's power via a conventional connection box 840, or any other acceptable arrangement. Note that the location and arrangement of the power feed 830 is illustrative only. In alternate embodiments, the luminaire's power feed can extend from an alternate location on the housing 120, or from one of the housing ends 140, 142, among other locations. Likewise, as described below, the power feed can also include various control and data lines for use in operating the luminaire and monitoring its function (power use, temperature, ballast condition, etc.), as well as controlling and monitoring other possible functions, such as a built-in surveillance camera, microphone or loudspeaker (described further below).

While the housing ends 140, 142 shown and described herein include an offsetting leg 240, this feature is optional in alternate embodiments and an end cap with a substantially planar arrangement between the lower housing ring and upper housing plate can be provided in alternate embodiments. Appropriate wire chase holes can be formed within the housing end to allow passage of wires from the upper to the lower housing in such a planar bracket arrangement so that the lens remains free of perforation and the sealing gasket is not compromised. For example, a central bore that passes from a portion of the housing end's upper housing end plate and through the top end of the lens mounting ring can be provided. Likewise, the housing ends can define an offset in which the upper housing is longer than the lower housing in an alternate embodiment.

Figure 2B:
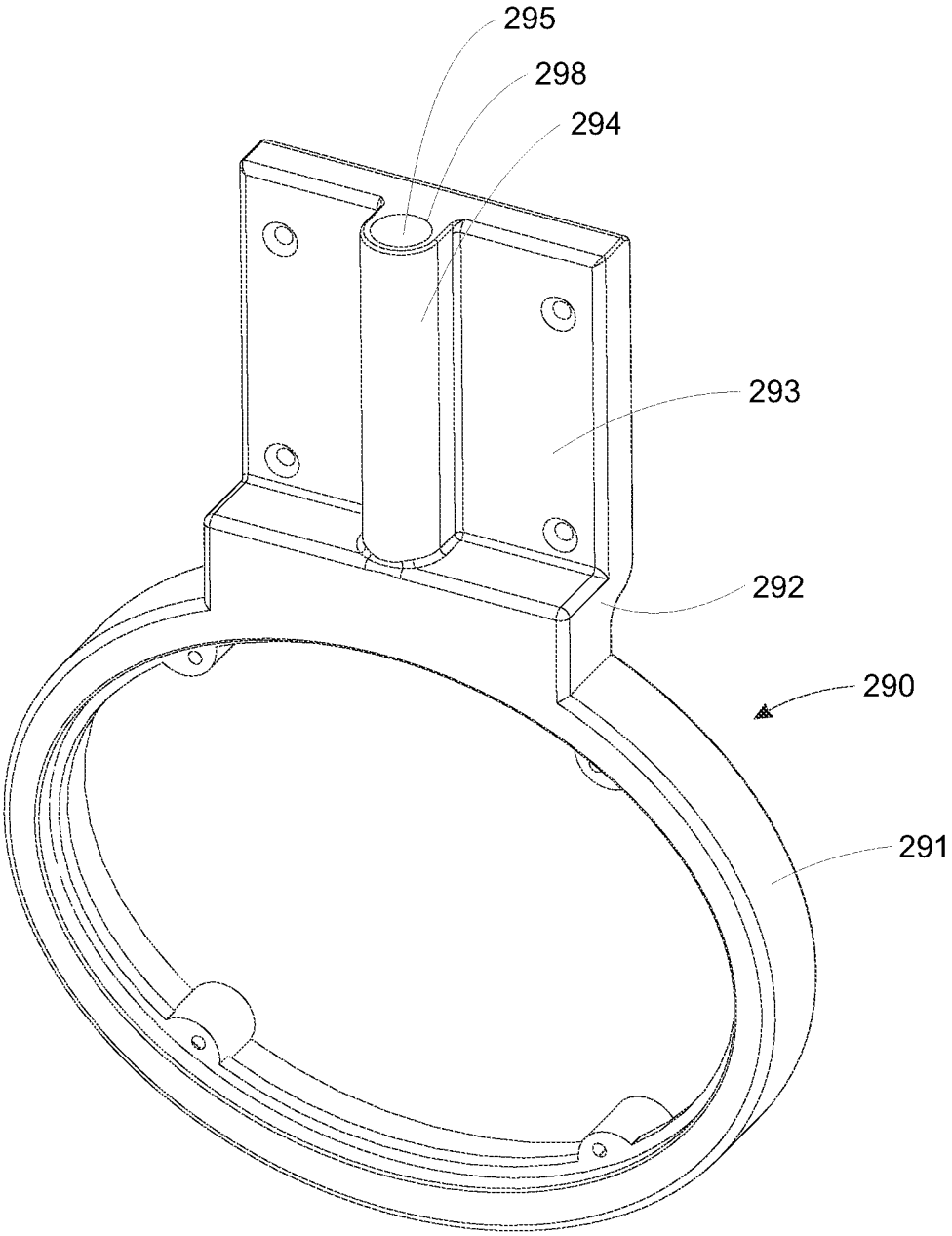
FIG. 2B is a frontal perspective view of a housing end including a unitary wiring harness chase and a shortened horizontal leg section according to an alternate embodiment.
Figure 2C:
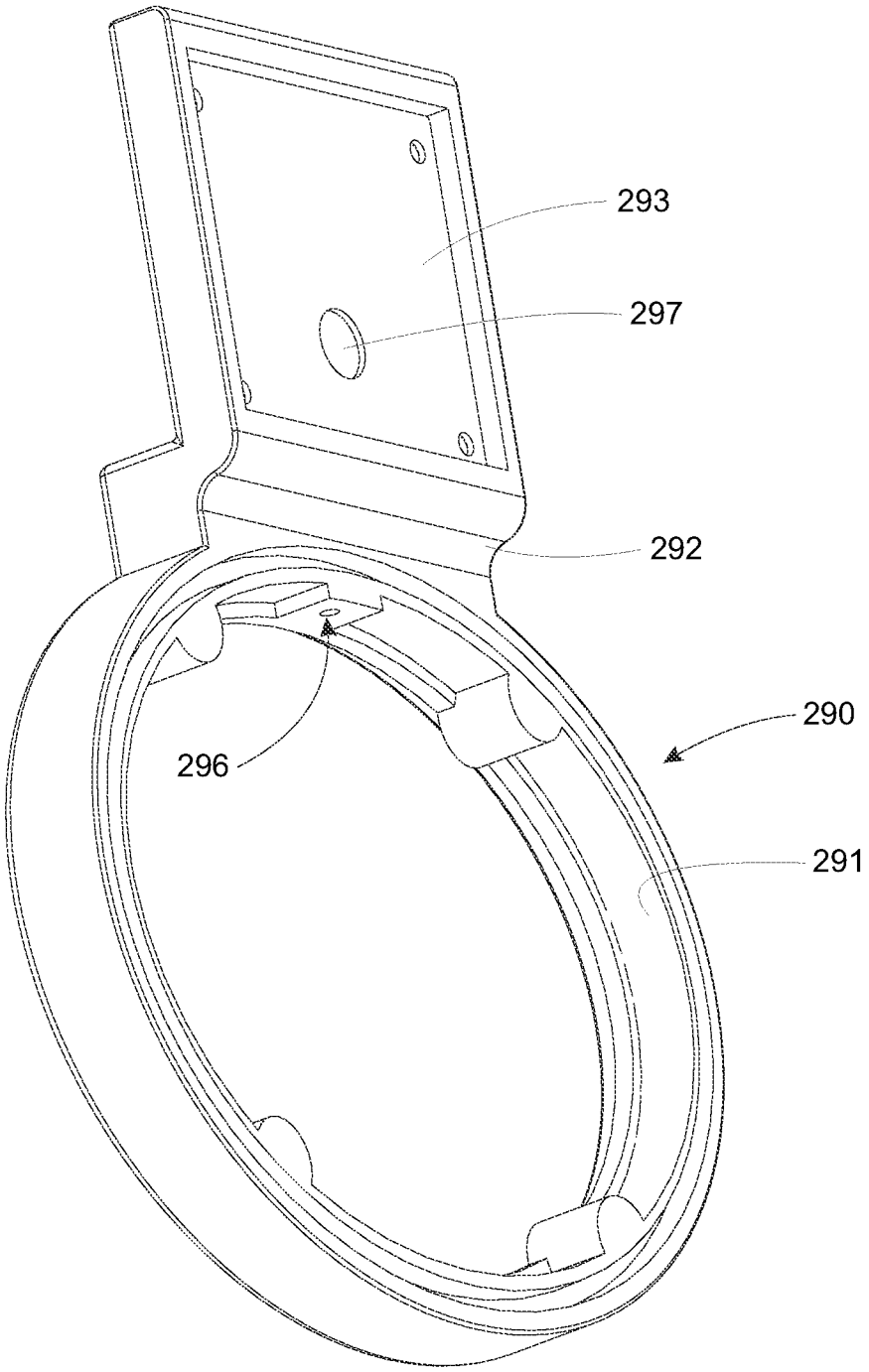
FIG. 2C is a reward perspective view of the housing end of FIG. 2B.

By way of further example, a housing end according to an alternate embodiment is shown with reference to FIGS. 2B and 2C. Like the embodiment of FIGS. 2 and 2A, this housing end 290 includes an appropriately shaped ring section for engaging a conforming lens/lower housing and supporting an appropriate end cap that can be the same, or different from those described above. A short horizontal leg 292 separates the ring 291 from the upper vertical plate 293, which is sized and arranged to engage and conforming cross-section upper/electronics housing (not shown). In this embodiment, the plate 293 defines a rectangular outline so as to engage a rectangular cross-section upper housing. The outline can be any acceptable cross-sectional shape in alternate embodiments. In this embodiment, the upper housing is longitudinally shorter than the lens by a lesser degree than the above-described embodiment. In alternate embodiments, the ring 291 and vertical plate can be sized and arranged so these housings are of approximately equal length or the lower housing is longer than the upper housing. In this embodiment, the use of a separate cap to seal off the harness is avoided using a unitarily (or integrally) cast (or machined, molded, welded-on, etc.) vertical shaft 294 that projects from the outside face of the vertical plate 293. The shaft can alternatively be part of a thickened vertical plate structure. Illustratively, the shaft encloses a bore 295 that exits the inner perimeter of the ring section 291 at a port 296. The bore 295 is intersected by another port 279 along the interior face of the vertical place 293. This port provides a chase for the wiring harness from the upper housing, through the bore 295, and out the port 296, so as to enter the lower housing. The harness chase formed by these bores and structures maintains a sealed relationship with only the top end 298 of the bore exposed to the environment. This top end 298 can be capped with a threaded plug and optional seal, such as an O-ring (providing a very reliable and long-term vapor-tight seal). The end of a ceiling-mounted rod (with appropriate seals) (or an adapter that engages the rod can also be secured to the bore end 298 via mating threads. In an embodiment, a threaded set screw is secured into the bore 295 in a position that resides above the port 297. A sealing ring or sealant can be provided to the set screw. A threaded mounting member is secured in the bore end 298 to provide a desired mounting arrangement for the luminaire after the sealing set screw is secured into the bore 295. It should be clear that a wide range of shapes and arrangements can be provided for the housing end and associated harness chase.

The electrical leads 774 (FIG. 7) of the power feed 830 are routed to the electronics 350 so as to provide line current and other electrical connections (e.g. control and data). The electronics 350 can consist of a variety of devices needed to properly distribute conditioned power to the lamps. Two alternative ballast types (electronic 353 and magnetic 355) are depicted, both fitting the interior of the upper housing with ample room for additional electronics and/or accessories. In alternate embodiments, as described below, the electronics can be any devices employed to control and optionally monitor the luminaire. For example, electronics can include appropriate remote control devices, as well as devices that send telemetry information over a wired link, or wirelessly, to a monitoring device. One such monitoring device can comprise a general purpose computer (PC) with appropriate peripherals. In addition, emergency backup power devices with appropriate batteries, etc. can be accommodated by the luminaire.

In the pendant embodiment of FIG. 8, the overall load of each housing 110, 120 is carried by the two opposing housing ends 140, 142. Thus, locating the mounting posts at these points relieves the middle sections of the luminaire from carrying the structural load of the unit. Nevertheless, the upper housing 120 is constructed and arranged to support the entire luminaire as shown in the optional mounting arrangement of FIG. 9. In this alternate arrangement, the luminaire has been mounted in close proximity to the ceiling surface 810 (or another support structure) using a pair of brackets 910 that engage the sides of the upper housing. In an embodiment, the brackets 910 include inwardly directed shoulders 928 that engage corresponding shoulders 930 formed along each side of the top edge of the channel member 270. In this manner, the brackets are free of attachment to the top cover. The brackets 910 can be formed from stamped steel or another acceptable material. They include holes or slots along their tops through which threaded rods or bolts 920 can be placed, such bolts being secured to the ceiling surface 810 as shown. This arrangement allows relatively flush mounting to the ceiling. The power feed 830 is interconnected with a junction box 942 or other structure formed on or into the ceiling 810. However, in this embodiment, a cap 940 is provided instead of the cover cap 193, and includes a port for the conventional sealing nut assembly 770. In this manner, the power feed 830 is allowed to exit through the side of the housing end 140 rather than through the top cover 740. This provides additional clearance for the run of the power feed and its interconnection with the junction box 940. The power feed 830 can be secured and sealed with respect to the housing end 140 using alternate mechanisms, such as direct mounting to the vertical plate 250. The depicted cap 940 also provides a sealed cover for the harness in this embodiment. Alternatively, the harness 1110 can be carried through a side of the luminaire separate from that of the power feed 830. The cap 940 or other structure for guiding the power feed can include appropriate gaskets such as the L-shaped gasket 366 described above. The number of brackets 910 used on a particular luminaire is highly variable, with two being the minimum number in a typical mounting arrangement. The placement of the brackets 910 along the longitudinal length of the upper housing 120 is also highly variable. Note also that the depicted brackets 910 advantageously allow for removal of the top cover (or at least one section of a multi-section top cover) due to their relative clearance from the top cover, which allows the cover to be lifted and withdrawn longitudinally within the space between the tops of the brackets and the top edge of the upper housing channel member. Likewise, the brackets 910 are free of fastening to the top cover 740, allowing for ease of removal. This is a further feature that enhances serviceability of the luminaire without need of dismounting it from a ceiling or other surface.

Figure 9:
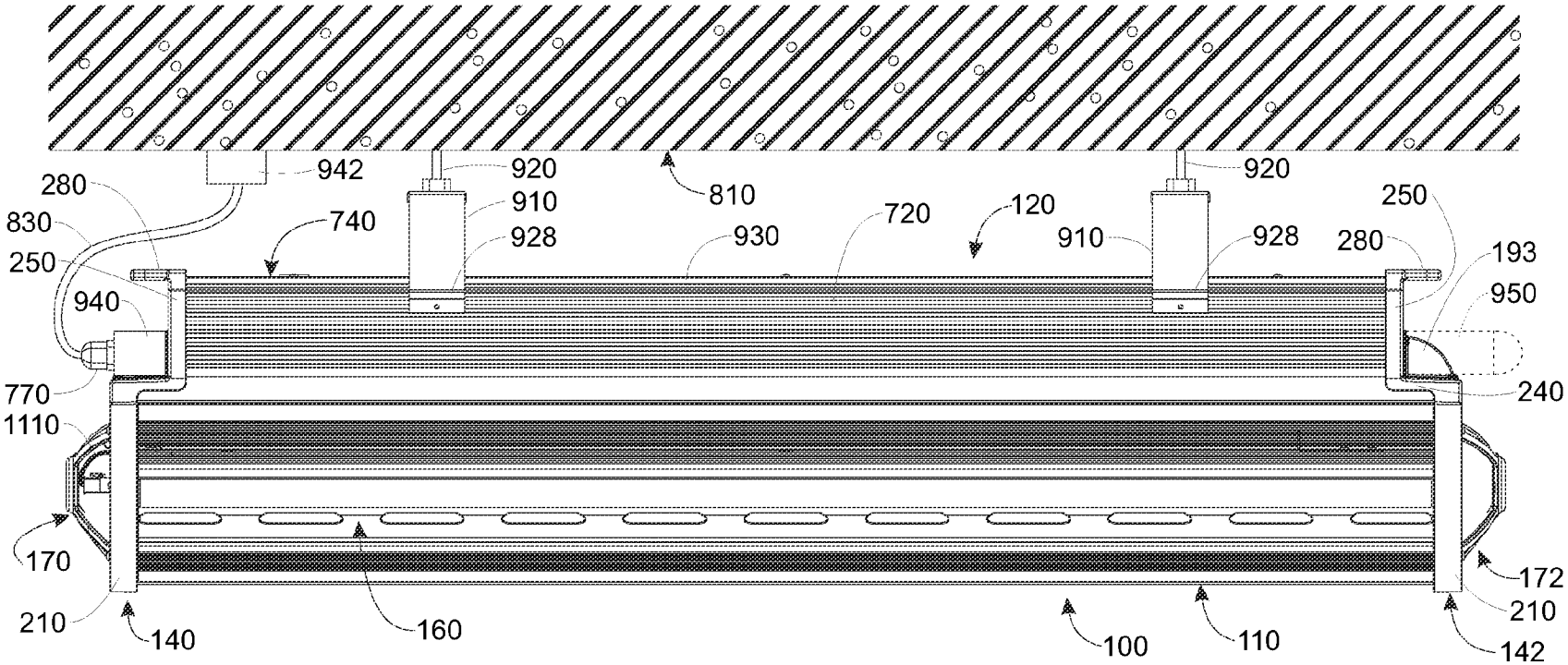
FIG. 9 is a side view of the luminaire of FIG. 1 shown flushly mounted to a ceiling surface via brackets attached to the upper housing.

As a further option for use on the depicted luminaire of FIG. 9, or any other embodiment contemplated herein, at least one housing end (142 as shown) can substitute the cover cap 193 with a mounted accessory 950 (shown in phantom). This accessory can include a gasket (like the above-described gasket 366) to seal the wire chases, and can be interconnected via an accessory harness with the upper housing, lower housing, or both, through the wire chases. The accessory can be any device that is sized and arranged to seat securely against the housing end's leg 240 and/or vertical plate 250. In this example, the accessory is a sensor or camera, but a wide variety of mountable accessories can be provided to one or both of the housing ends 140, 142. Additional fastener holes can be provided to mount accessories, or the original cover cap screw holes can be used to apply fasteners to secure the accessory.

While the luminaire 100 in the illustrative embodiments is shown in a horizontal mounting orientation with respect to a ceiling or other overhead structure, it is expressly contemplated that the luminaire can be mounted in a non-horizontal orientation—for example in a vertical wall-sconce application. The bases 280 or brackets 910 can be used to interconnect the luminaire with appropriate mounting structures (bolts, lags, etc.) on a wall surface. As described above, the length of the luminaire is highly variable, and a shortened version can be used for a wall-mounting application in various embodiments. Again, the versatility of the luminaire according to embodiments herein is substantial.

Notably, the housing ends 140, 142 are sized and arranged so that, when the gaskets 365 and 322 are in place, the action of securing the screws 370 causes the vertical plate 250 of each housing end to compress firmly against the respective end of the channel member 720. This, in turn causes the ring sections to compress against the respective end of the lens with the gasket 322 being deformed to form a vapor-tight seal. No additional fasteners or clamps are needed, so long as the dimensions of the lens and the housing ends are sufficiently precise and the housing ends are sufficiently rigid. Thus, assembly of the basic upper and lower housings into an integral unit is relatively straightforward, and disassembly of the housings from the overall unit for service and replacement of components is similarly straightforward with the removal of the screws 370 from at least one side and the withdrawal of the respective housing end from each housing 110, 120.

In the above-described mounting arrangement in which the housing ends support the upper and lower housings in a spaced apart relationship it is recognized that the lens essentially floats along its longitudinal length with little or no force applied to it by the weight of the internal components. The lens 150 is captured between the housing ends and held in place by the pressure exerted by the each housing end ring 210 on the seals and the confronting edge of the lens. This mounting and sealing arrangement not only facilitates a lens surface that is free of penetration along its length and about its perimeter, but also ensures that the sealing pressure is uniform about the entire edge of the lens at each opposing end thereof. Moreover, the pressure exerted by the sealing arrangement is directed along the longitudinal direction, which is the lens' strongest dimension (as a supporting column). This minimizes any deformation between the seal and the lens edge even when significant sealing pressure is applied by the housing ends to the lens. Conversely, the conventional clamshell arrangement is sealed along a relatively weak direction.

It is desirable that the housing ends 140, 142 are tightened onto the channel member 279 with the appropriate degree of force and in a manner that ensures that each ring 210 is substantially vertical and parallel with respect to the other ring. This ensures that the desired even sealing pressure is applied about the perimeter of each opposing edge of the lens. Reference is made again to FIG. 2A showing a rear perspective view of the housing end 140 (the opposing housing end 142 being a mirror image). The rim 710 of the vertical plate 250, which surrounds an end of the channel member 720, is shown including the fastener holes 260 that receive screws 370. As described above, the screws 370 draw the housing end 140 toward the upper housing channel member 720 to provide requisite compression force to compress the gaskets between the ring 210 and the lens edge. Because a gasket 365 resides between the inner surface 291 of the vertical plate 250 and the edge of the channel member 720, the screws may unevenly compress these two components together. Thus, a set of bumps 295 having a projection distance of approximately 1/32-3/32 inch and a diameter of approximately 1/16-3/16 inch are formed on the inner surface 291 at locations that confront the edge of the channel member when it is seated within the rim 710. The bumps 295 cause the gasket 365 to compress to a very thin profile where they contact the gasket. They essentially come into contact with the edge with a thin section of gasket therebetween. This allows the screws to be driven to a predetermined maximum torque while ensuring that the surrounding gasket is compressed to an appropriate degree, and not overcompressed by any of the screws 370. This even compression ensures that the housing end 140 (and 142) remains vertical, and that the force exerted by the ring 210 on the lens is constant and predictable about the circumference of the lens edge. In other words, the bumps act as stops to further compression of the housing ends while avoiding puncture of the underlying gasket due to the durability of the gasket material.

II. Reflector and Lamp Assembly

Figure 10:
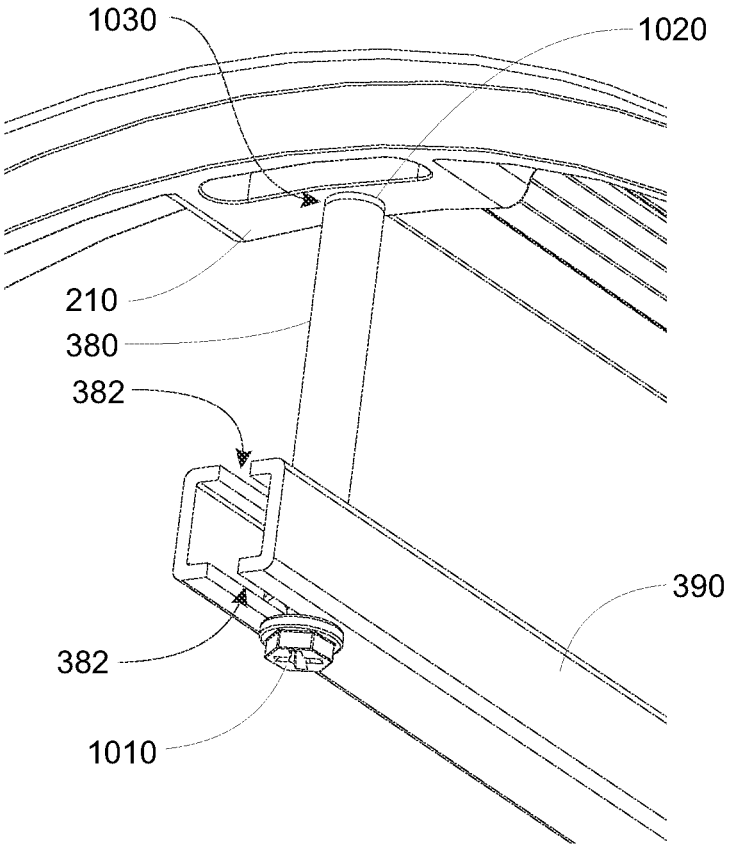
FIG. 10 is a fragmentary perspective view of the ring section of a housing end of the Luminaire of FIG. 1, showing a support post and an end of the rail upon which the reflector and lamp assembly is slidably mounted.

Reference is made to the exploded view of FIG. 3 and the fragmentary closeup view of FIG. 10, which shows a pair of posts 380, each of which is mounted on the top inner edge of a respective housing end ring section 210. The posts are slotted to receive corresponding slots 382 in a square-cross-section channel member or "rail" 390 that extends the length of the lower housing between the posts. A screw 1010 (FIG. 10) retains each end of the rail 390 with respect to the post. The post 380 can include a threaded end 1020 that is received by a threaded receiving hole 1030 in the ring section 210. When mounted, the square channel or rail 390, which can be formed from extruded carbon steel with an approximate wall thickness of 0.065 inch (or another material, such as aluminum stock). Alternatively, the rail 390 can be constructed from composite or any other acceptable material). The rail allows the reflector and lamp assembly 160 to slide into and out of the lower housing 110 and retains it securely in the housing when fully mounted. The rail is shown as a hollow square-cross section member, but can comprise an alternate shape in various embodiments (e.g. a T-shape, triangle, oval, etc.). The reflector and lamp assembly can be adapted to mate with the illustrative rail shape.

Figure 11:
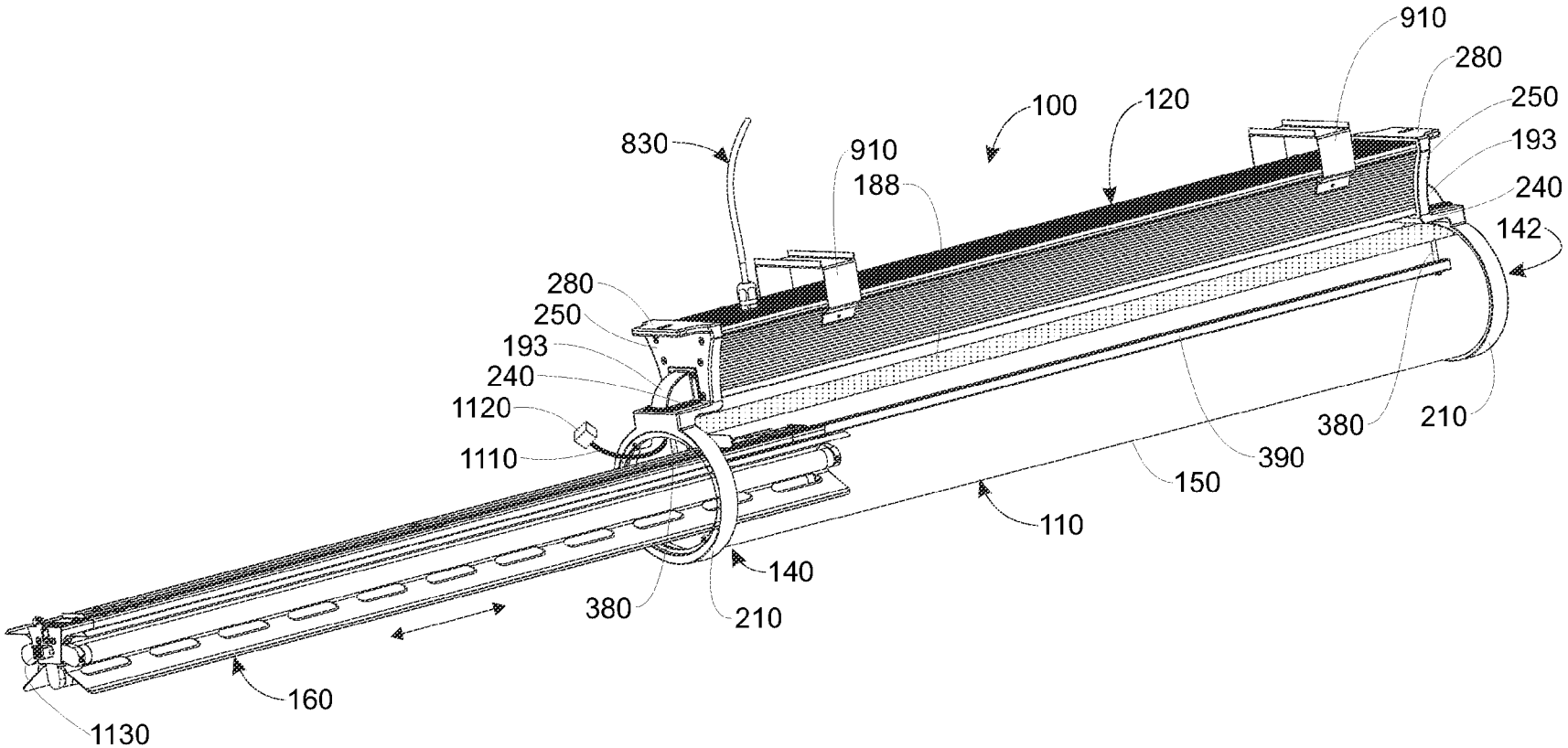
FIG. 11 is a perspective view of the luminaire of FIG. 1 showing an end cap of the lower housing removed and the reflector and lamp assembly being partially slidably moved into or out of the housing.
Figure 12:
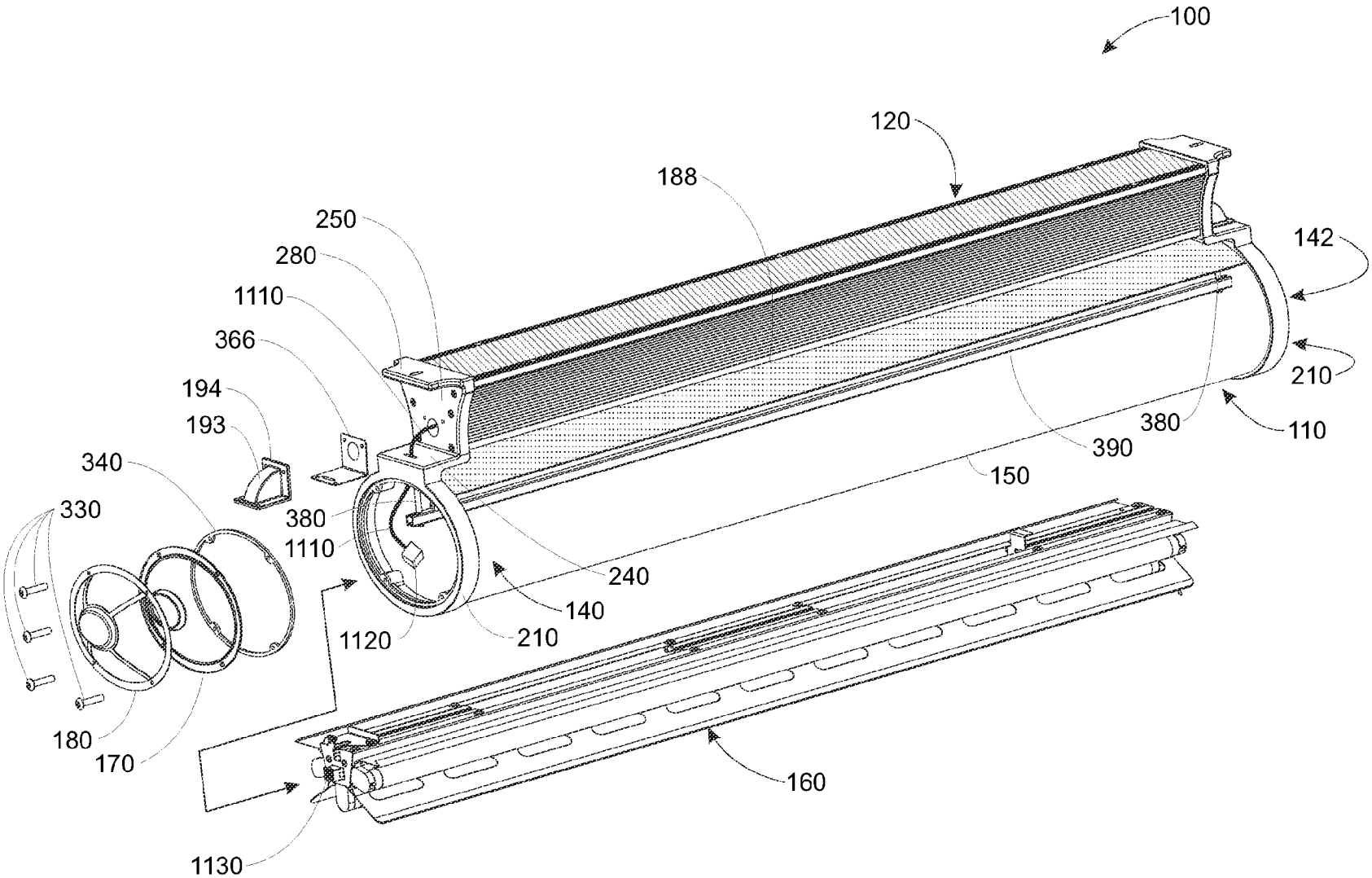
FIG. 12 is a partial perspective view of an end of the luminaire of FIG. 1 with an end cap and the reflector and lamp assembly completely removed from the lower housing, and showing the rail upon which the reflector and lamp assembly (and other light sources) are slidably mounted.

Reference is now made to FIGS. 11 and 12 which respectively show the reflector and lamp assembly 160 partially and fully removed from the lower housing 110. The reflector and lamp assembly 160 includes a central frame (described in detail below) that is sized and arranged to slide on the rail 390 so that the assembly 160 can be easily mounted in the housing by aligning an end of the frame with the rail 390 and sliding it fully into the housing 110 and engaging a locking mechanism to retain it in this position. The assembly 160 can be removed by unlocking it and drawing it down the rail until it is free of the housing as shown in FIG. 12. In attaching and removing the reflector and lamp assembly 160 a multi-pin connector 1120 on the end of the harness 1110 is manipulated with respect to a mating connector 1130 on the assembly. This connector directs power and other associated signals to each of the lamps in the assembly. The connector is 1120 is attached to the assembly's connector 1130 after mounting is complete. Likewise, the connector 1120 is detached from the assembly's connector 1130 (and the harness 1110 is moved to a non-interfering position) before the assembly 160 is withdrawn from the housing 110. The use of a novel connector system (1120, 1130) makes attachment and removal of reflector and lamp assemblies significantly more convenient as all wiring is carried through a single connector. This reduces the possibility of mis-wiring the lamps and significantly speeds the connection process. As shown, the space occupied by the joined connectors extends into the end cap (170) region, making the extended dome shape desirable to provide clearance.

Note that the luminaire 100 of FIG. 11 is shown with the optional brackets 910 described above. These brackets are shaped with an inward detent that conforms to the shape of the channel member. The brackets 910 can be secured using set screws (shown as circles on the lower end of each bracket), which engage the side of the channel member 720. It is otherwise similar in all respects to the illustrative embodiment shown in FIG. 1.

Figure 13:
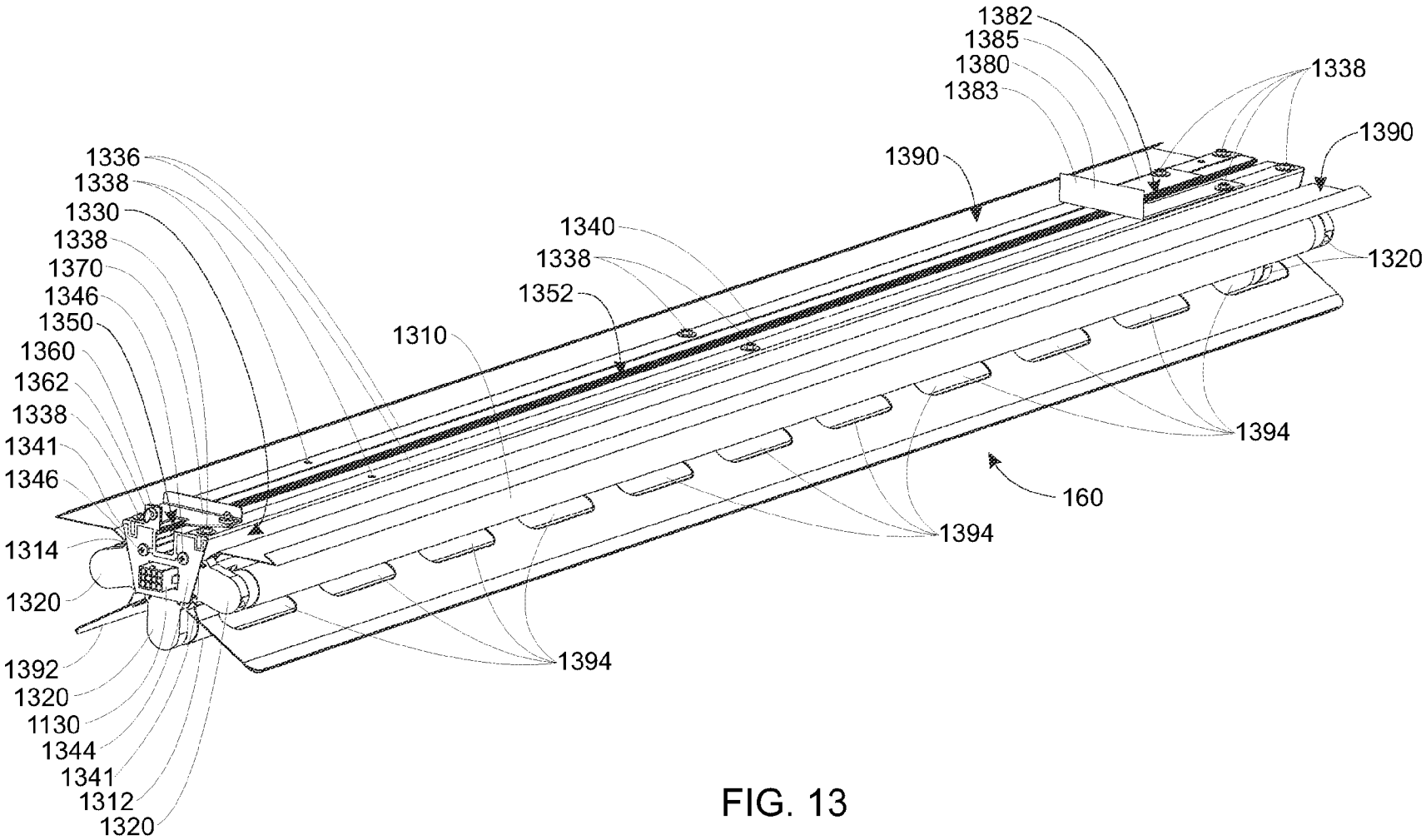
FIG. 13 is a perspective view of the reflector and lamp assembly, providing three fluorescent lamps according to an illustrative embodiment.
Figure 14:
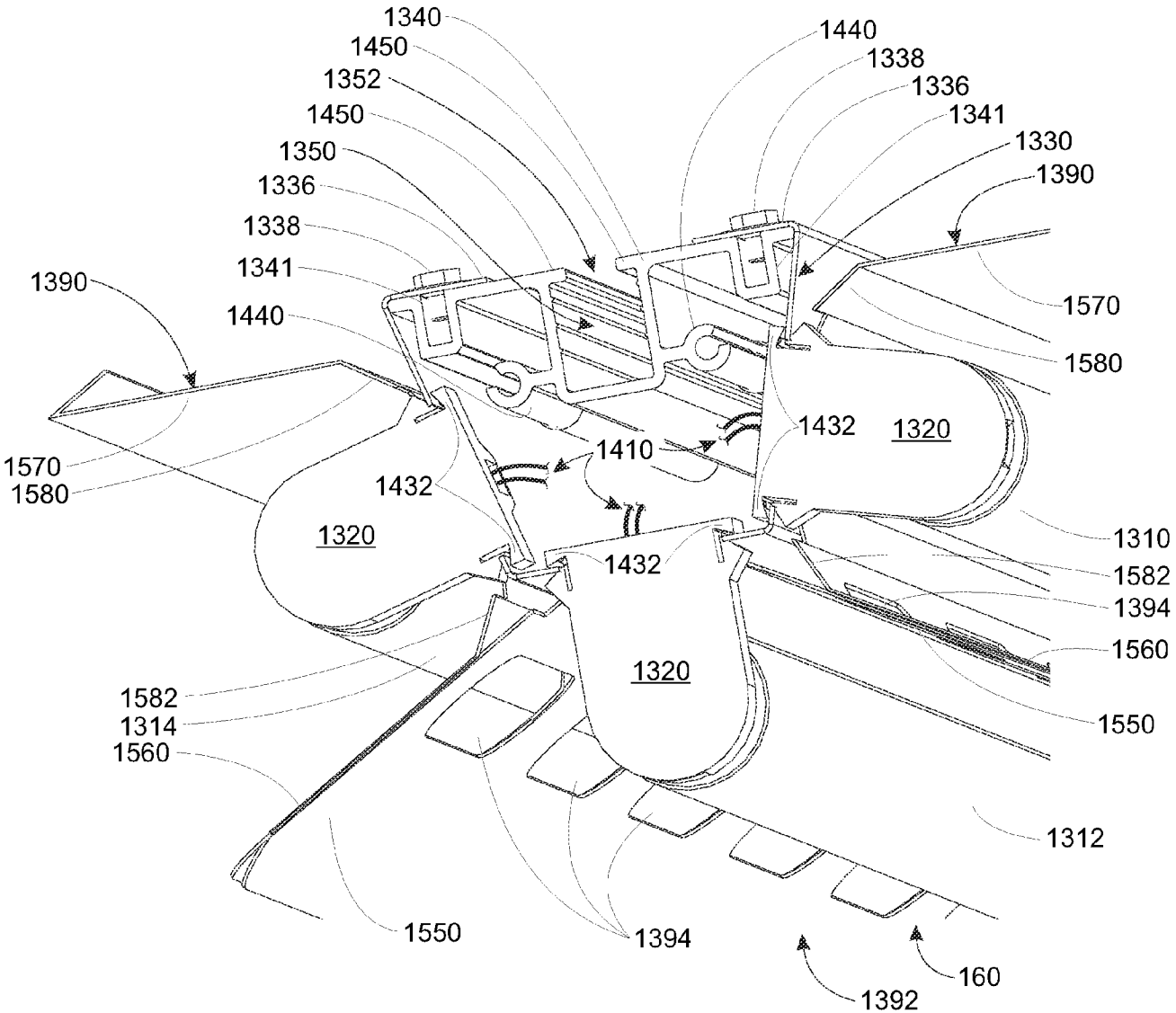
FIG. 14 is a fragmentary perspective view of an end of the reflector and lamp assembly with end cap removed to reveal a the cross section of the top frame member.
Figure 15:
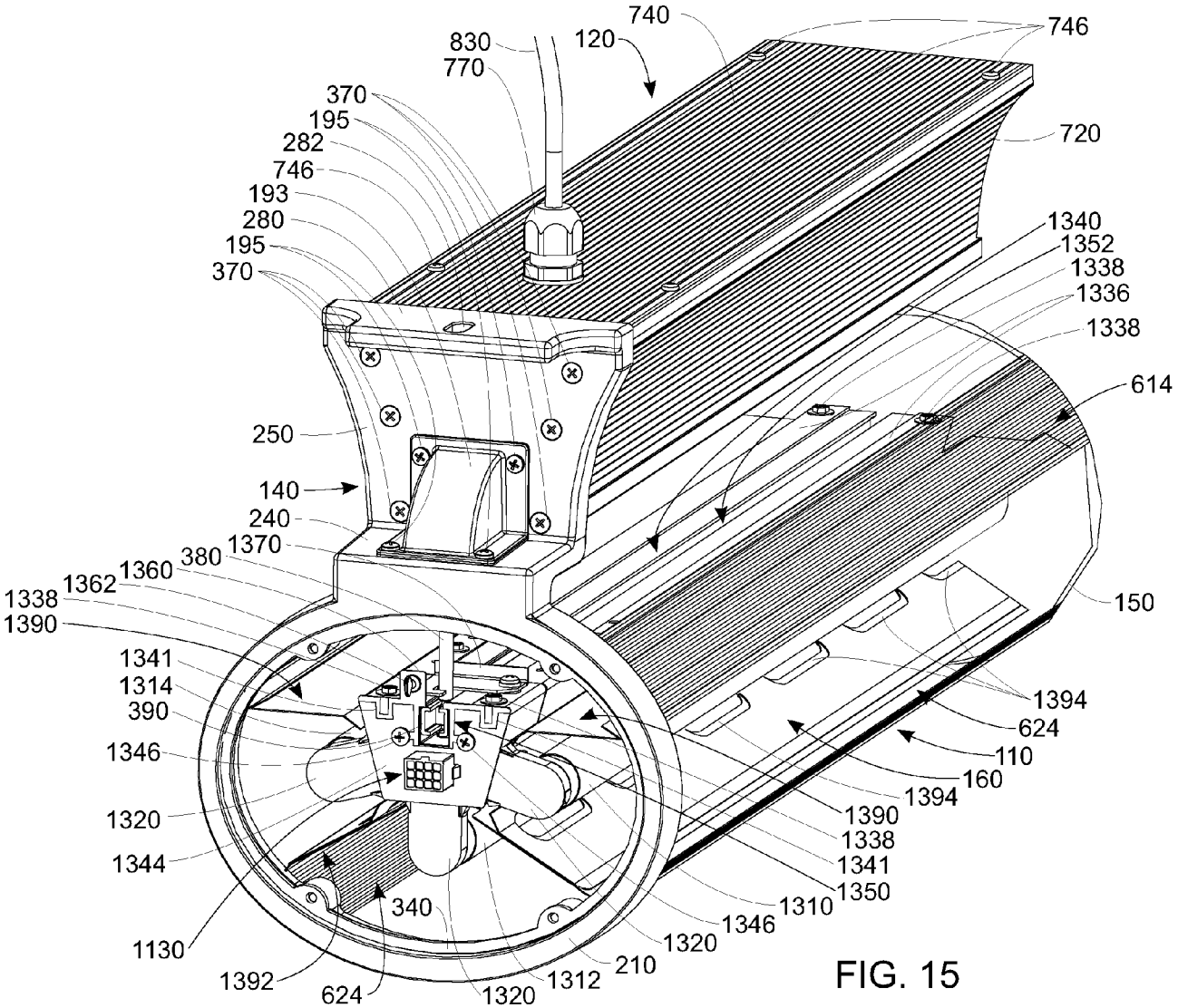
FIG. 15 is a fragmentary perspective view of an end of the luminaire of FIG. 1 with the end cap removed to reveal the end connector and locking mechanism of the reflector and lamp assembly.

Reference is now made to the perspective view in FIG. 13 showing the overall reflector and lamp assembly 160 in a three-fluorescent-lamp configuration according to an embodiment. Reference is also made to FIGS. 14 and 15, which show an end of the assembly 160 with an end cover plate removed and a partial perspective view of the end of the luminaire showing the assembly's locking mechanism engaged. The reflector and lamp assembly 160 of this embodiment comprises three fluorescent lamps 1310, 1312, 1314 arranged with the bottom lamp 1312 directly along the vertical centerline, and each side lamp 1310, 1314 symmetrically placed on an opposing side in a slightly, downwardly angled orientation. As described further below, this is only one possible orientation. The lamps are electrically connected to the ballast (355) via the connecting harness 1110 and mating multi-pin connectors 1120, 1130 using conventional bi-pin lamp holders 1320. The lamp holders 1320 are located on each opposing side of each, respective, lamp. Each pair of connectors physically supports the lamp at opposing ends. The connectors have leads 1410 that are routed to respective pins in the assembly's multi-pin connector 1130. These pins are removably attached to associated pins in the harness connector 1102, which is operatively connected with the ballast and electronics in the upper housing 120. Thus as also described above, no loose wires or splicings are required between the reflector and lamp assembly 160 and electronics.

It should be clear that, while a conventional, tubular fluorescent lamp is employed in this embodiment, the assembly can be used to mount other types of lamps that are adapted to install in the depicted bi-pin lamp form factor. For example LED-based tubular lamps can be employed in this embodiment, as well as compact fluorescents, etc. As described below, alternate for factors can be accommodated by entirely different lamp assemblies that are exchangeably mountable within the lower housing 110.

The reflector and lamp assembly 160 is centered around a main core housing 1330, which can be formed from sheet aluminum or sheet steel via a stamping or extrusion. Another material can be employed in alternate embodiments. In an embodiment, the housing is approximately 1.8 inches high on the vertical and tapers between a width (on the horizontal) between 2.5 inches at the top and 1.5 inches at the bottom—the downward taper thereby providing a downward slant to the side lamps 1310 and 1314. This slant is between approximately 12 and 18 degrees from the vertical in an embodiment, but this value is highly variable in alternate embodiments. These dimensions and angles can be altered in various embodiments, in part, to change the optimetrics of the luminaire as desired. In an embodiment, the ends of the core housing 1330 are notched to receive bases 1432 of the bi-pin lamp holders 1320. The top side of the core housing 1330 is defined by inwardly directed shoulders 1336 that provide a gap along the length of the core housing 1330. This gap is filled by an extruded aluminum top frame 1340 that spans the top side of the core housing 1330, and is secured to the core housing's shoulders by self-threading screws 1338 that each engage an extruded screw receiver 1341 on their respective side of the housing 1330. The top frame 1340 is constructed from 6063 aluminum alloy in an illustrative embodiment. Its walls have an approximate thickness of between 0.06 and 0.09 inch in an illustrative embodiment. However other materials and dimensions are expressly contemplated in alternate embodiments. The combination of the extruded top frame 1340 and core housing 1330 provides a sturdy and rigid, but relatively lightweight beam that is constructed with a minimum of parts and materials.

Each end of the core housing 1330 and top frame 1340 is capped by an end cap 1344 that can be constructed from steel plate (or plate of another material). At least one end cap 1344 carries the harness connector 1130 as depicted. Each end cap 1344 is secured using at least two self-threading screws 1346, that engage a respective receiver 1440 formed in the top frame 1340 as part of the extrusion. Each end cap 1344 includes a cutout that provides clearance from a C-shaped channel 1350. The channel is sized the surround the rail 390 with minimal play. The top of the channel 1350 contains an open slot 1352, which is narrower than the internal width of the slot due to a pair of inwardly-directed top shoulders 1450. The slot 1352 is sized to provide clearance for the posts 380 as the assembly 160 is slid onto and off of the rail 390. The size and shape of the internal cross-section of the channel 1350 and slot 1352 is adapted to the external cross section of the rail 390. In alternate embodiments, the internal cross-section of the channel can be varied to accommodate a rail with a different external cross section shape. By forming the channel 1350 in the extruded top frame, a high degree of precision in fit between the rail and channel can be achieved, reducing motion between these components due to vibration, etc. It should be clear that in alternate embodiments, the slidable engagement between the lower housing 110 and reflector/lamp assembly 160 can be achieved by a variety of other interengaging arrangements. For example, the depicted rail can be omitted, and the assembly can be mounted directly on posts with appropriately shaped ends. Likewise, a plurality of parallel rails can be provided in the housing 110 to engage side by-side channels in the assembly.

At least one end cap 1344 on the reflector and lamp assembly 160 includes an L-shaped tab that carries a thumbscrew 1362. This thumbscrew 1362 removably engages a hinged gate 1370, having a pivot formed by a screw on one side of the top frame 1340. The gate selectively crosses the slot 1352 and acts as a stop against the post 380. When the thumbscrew 1362 is loosened, the gate 1370 can be pivoted out of an interfering position with the front post 380, and the assembly 160 can be slid fully onto or off of the rail 390. A rear stop 1380 (FIG. 13) is also provided. In an embodiment, the rear stop 1380 is placed further inboard, as shown, to prevent inadvertent, complete pull-out of the assembly 160 by engaging the front post (the post normally locked by the gate 1370) after the assembly has been slid out of the housing 110 to a predetermined position. The stop 1380 includes a vertical leg 1383 and horizontal leg 1385. The horizontal 1385 leg is secured to the top frame 1340 by screws 1338. There is a notch 1382 that extends along the horizontal leg 1385 to an open rear mouth. Complete removal (pull-out) entails removing the end cap 172 adjacent to the stop 1380, and directing the lamp assembly 160 rearwardly so that the rear post rides within the notch 1382. In this position, the stop can be unfastened by removing one or more of its screws 1338. In most instances, where the lamp assembly 160 is being serviced (e.g. replacing lamps), there is no need to completely remove it from the housing, and the rear stop 1388 provides a desirable safety mechanism to prevent unwanted, complete pull-out and dropping of the assembly 160 during service. For example, where lamps are replaced, complete pullout of the assembly 160 may be unnecessary, and the assembly need only be exposed sufficiently to remove the old lamps from the holders and install the new lamps. However, where full removal of the lamp assembly is desired, such as in a retrofit operation, then removing the stop 1380 is desirable. The stop 1380 is positioned along the assembly 160 so that there is sufficient rail-to-channel engagement to prevent the assembly from breaking off the rail due to weight-induced torque. In an embodiment, three to five inches of mating length between the rail and the channel should be sufficient to avoid breakage.

In alternate embodiments, the stop can include a latch mechanism according to a conventional or custom design (for example a bullet catch) that allows it to be released from the opening of the lower housing 110 after the end cap 170 has been removed. The avoids the potential need to remove the rear end cap 172 to (first) remove the stop 1380 before fully withdrawing the lamp assembly 160. Note that in instances where both end caps 170 and 172 are removed, the lamp assembly 160 can also be removed from the rear end once the stop 1380 has been moved to a non-blocking position and/or removed from the assembly.

The reflector and lamp assembly 160 of this embodiment includes reflectors that run the elongated length of the assembly and surround each lamp 1310, 1312, 1314, extending approximately out to the inner wall of the lens 150. The above-described fluted surfaces (614, 624 in FIG. 6) in the lens 150 can be located to specifically account for the positioning to the outer edges of the reflectors. In an embodiment, the reflectors comprise a pair of opposing side reflector assemblies 1390 that surround the side lamps 1310 and 1314, and a bottom reflector assembly 1392. The bottom reflector assembly includes a pair of opposing panels 1550 (FIG. 15) that extend along opposing planes in a somewhat V-shape from the core housing 1330. The side reflector's (1390) bottom panels 1560 are generally flush with the opposing (non-exposed) surfaces of the panels 1550. Likewise the top panels 1570 of the side reflector assemblies 1390 extend substantially horizontally, assisting in avoiding spread of excess light onto the ceiling. The region of these side reflector assemblies, adjacent to the core housing 1330 and respective lamps 1310, 1314 define intermediate-angled transition segments 1580 and 1582 between a flat reflector surface that engages the core housing beneath each lamp and the respective, outwardly extended bottom and top panels 1560 and 1570. The overall side reflector cross section ensures that an efficient spread of light is achieved. The spread of light can be further enhanced by providing a series of optional slots 1394 through the panels 1550 and 1560 that allow migration of some light from the sides to the bottom so as to enhance the amount of light projected through the luminaire bottom. The size, shape and elongated spacing of the slots 1394 are highly variable. In an embodiment, the slots are ½-1 inch wide and 1-2 inches long.

In an alternate embodiment, the bottom reflector can be formed using the opposing sides of the side reflector's bottom panels. In this manner, a separate bottom reflector unit is not required.

The surface finish of each reflector assemblies' exposed surfaces is highly variable. In an embodiment, the surfaces have a highly specular surface finish achieved by anodizing, polishing, plating and/or another acceptable technique. The reflector substrate can be aluminum or another acceptable material.

By way of useful background, the optimetrics and general geometric layout of reflectors and fluorescent lamps for the illustrative assembly 160, and others described herein, is provided in the above-incorporated U.S. Pat. No. 7,588,347, entitled LIGHTING FIXTURE, by Richard D. Edwards, Jr.

It should be clear the geometry of the lamps and reflectors in the assembly 160 described above should be taken only by way of example. It is expressly contemplated that the geometry can vary widely in alternate embodiments. In fact, an advantage of the luminaire 100 according to the illustrative embodiment is that a single housing 110 can accommodate a wide range of lamp arrangements, geometries and types. As described above, mounting and change-out of assemblies is highly straightforward and can be accomplished with minimal time and skill. One possible implementation is to provide a particular full-spread assembly to certain installations, and provide a specialized-optimetric assembly to other installations within a given space. For example, one optimetric can be used in the center of a space, while another optimetric can be used to more-efficiently light the corners of the space, or to light areas within higher or lower ceilings. The versatility provided by the illustrative luminaire is substantial.

III. Alternate Lamp Assemblies and Lamp Types

Figure 16:
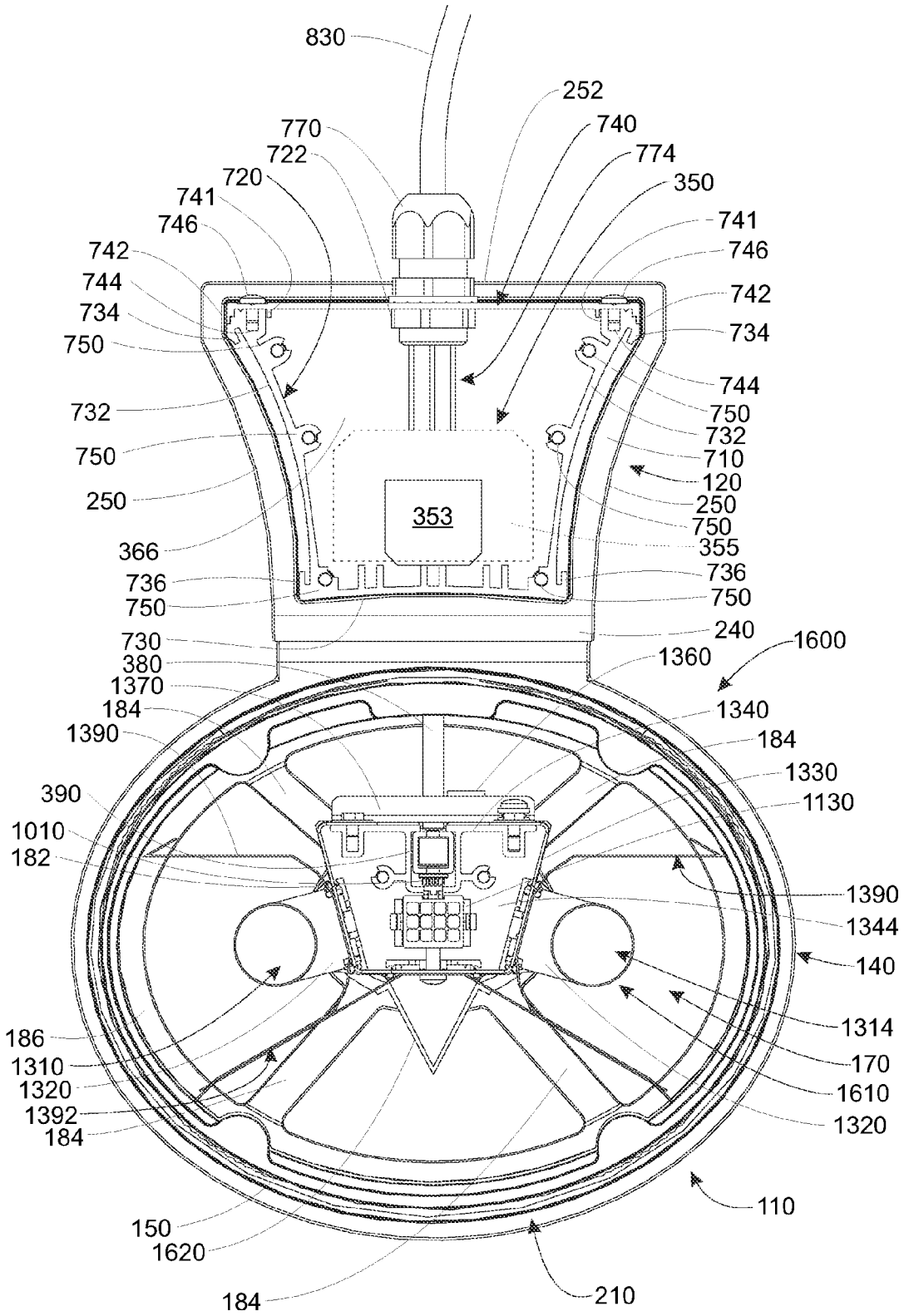
FIG. 16 is a side cross section of the luminaire of FIG. 1 having a two-fluorescent lamp reflector and lamp assembly according to an alternate embodiment.

As described above, the versatility of the luminaire according the various embodiments contemplated herein makes possible a variety of options for lamp arrangement and even lamp type. With further reference to FIG. 16, a cross section of the luminaire 1600 is again depicted at a location along its length similar to that shown in FIG. 7). Like components are thus given the same reference numerals. In this embodiment, a reflector and lamp assembly 1610. In this arrangement, the bottom lamp 1312 has been omitted and a specular peaked reflector assembly 1620 occupies the location of the lamp 1312. This reflector 1620 is sized and shaped to reflect light passing through the above-described slots 1394 so that light from the side lamps is projected from the bottom in the form of a "false lamp". In this manner, performance similar to a three-lamp arrangement can be achieved with only two lamps. The cross section of the peaked reflector 1620 is triangular, but a variety of polygonal and/or curvilinear cross sections can be provided in alternate embodiments. The assembly 1610 is one of a wide variety of arrangements using a plurality of fluorescent lamps and reflectors. More particularly, other arrangements, including asymmetrical arrangements (for example, to illuminate corners or walls) can be employed in alternate embodiments.

Figure 17:
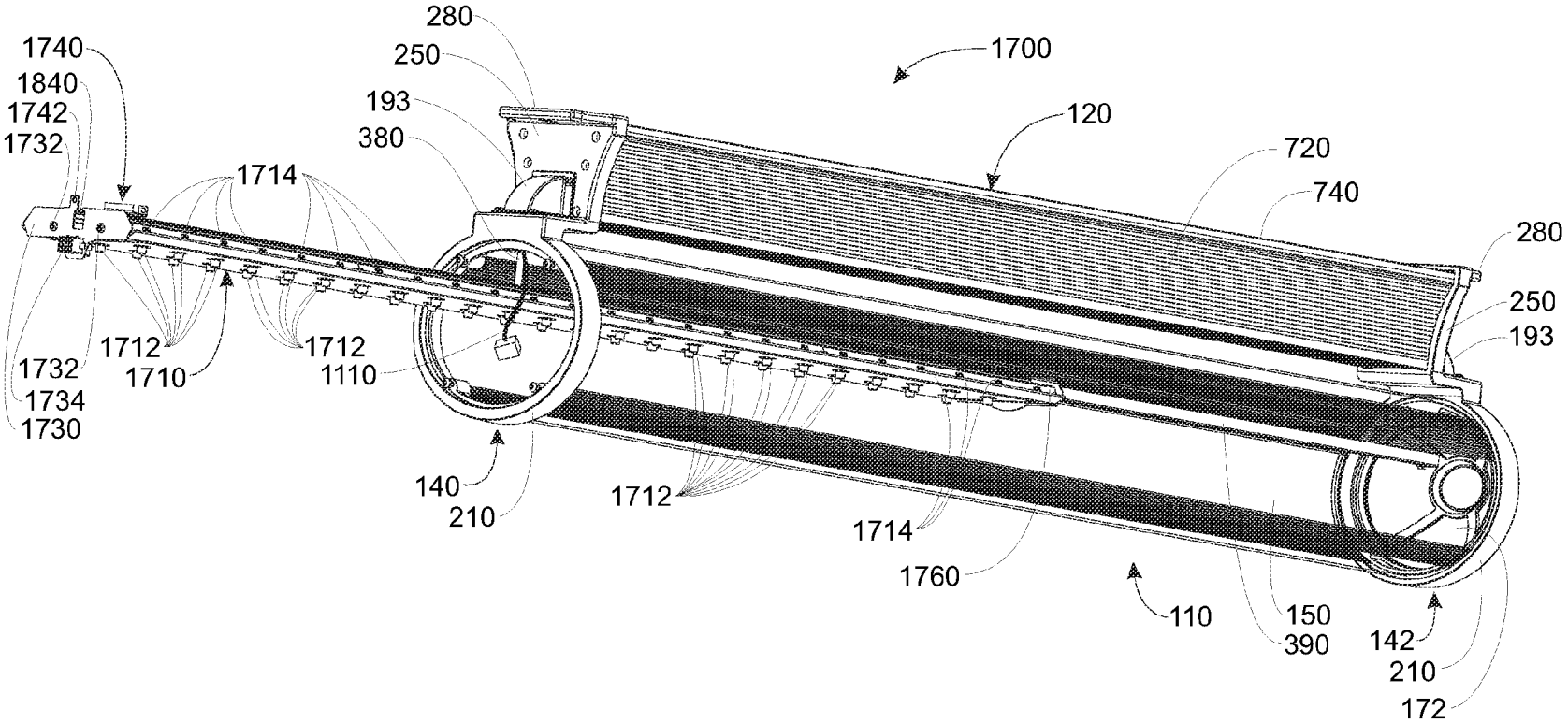
FIG. 17 is a perspective view of the luminaire of FIG. 1 with an LED-based lamp assembly mounted therein, and showing an end cap removed and the LED-based lamp assembly partially removed from the lower housing.
Figure 18:
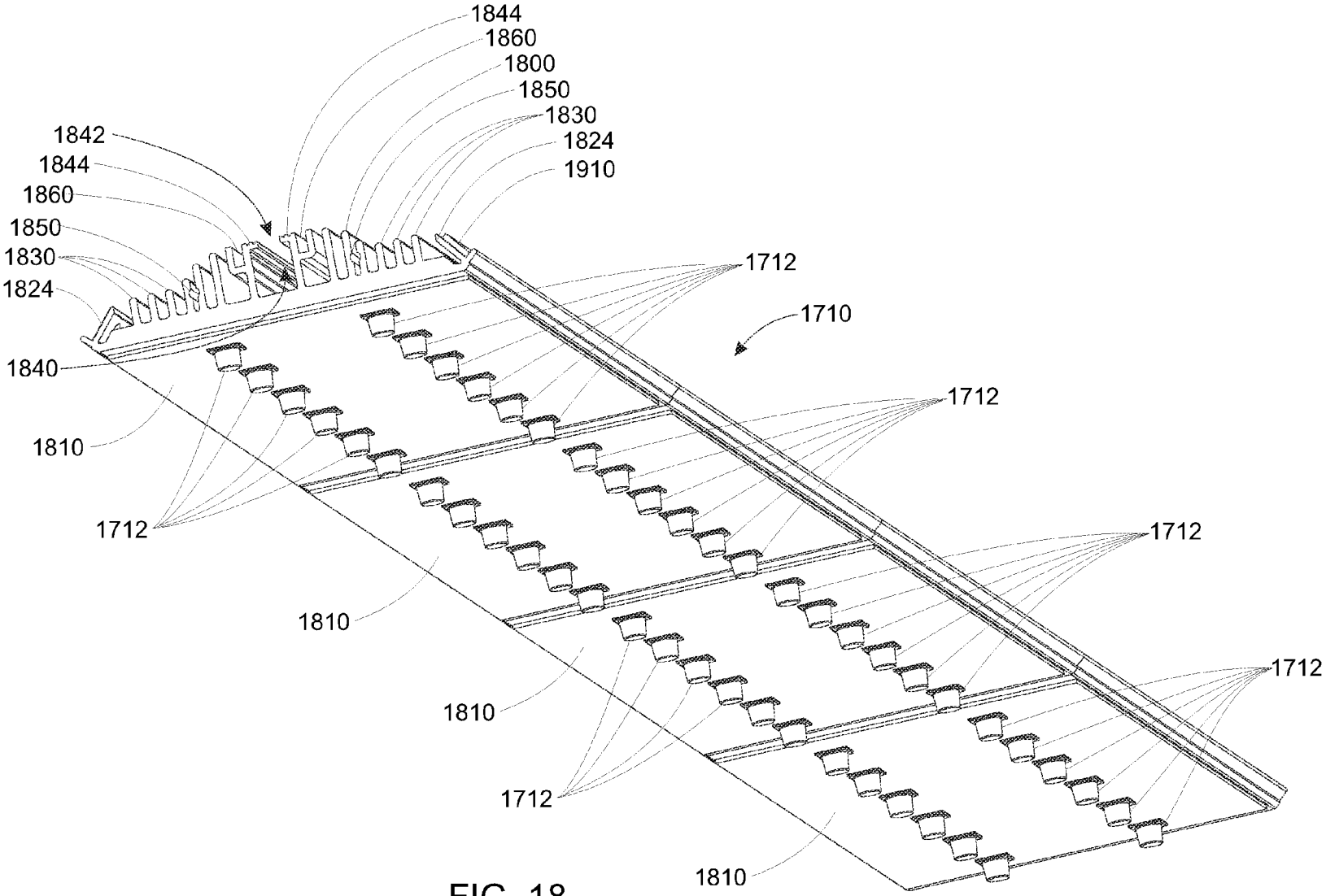
FIG. 18 is a bottom perspective view of the lamp assembly of FIG. 17 detailing the structure of the heat sink with and end plates and locking mechanism omitted.
Figure 19:
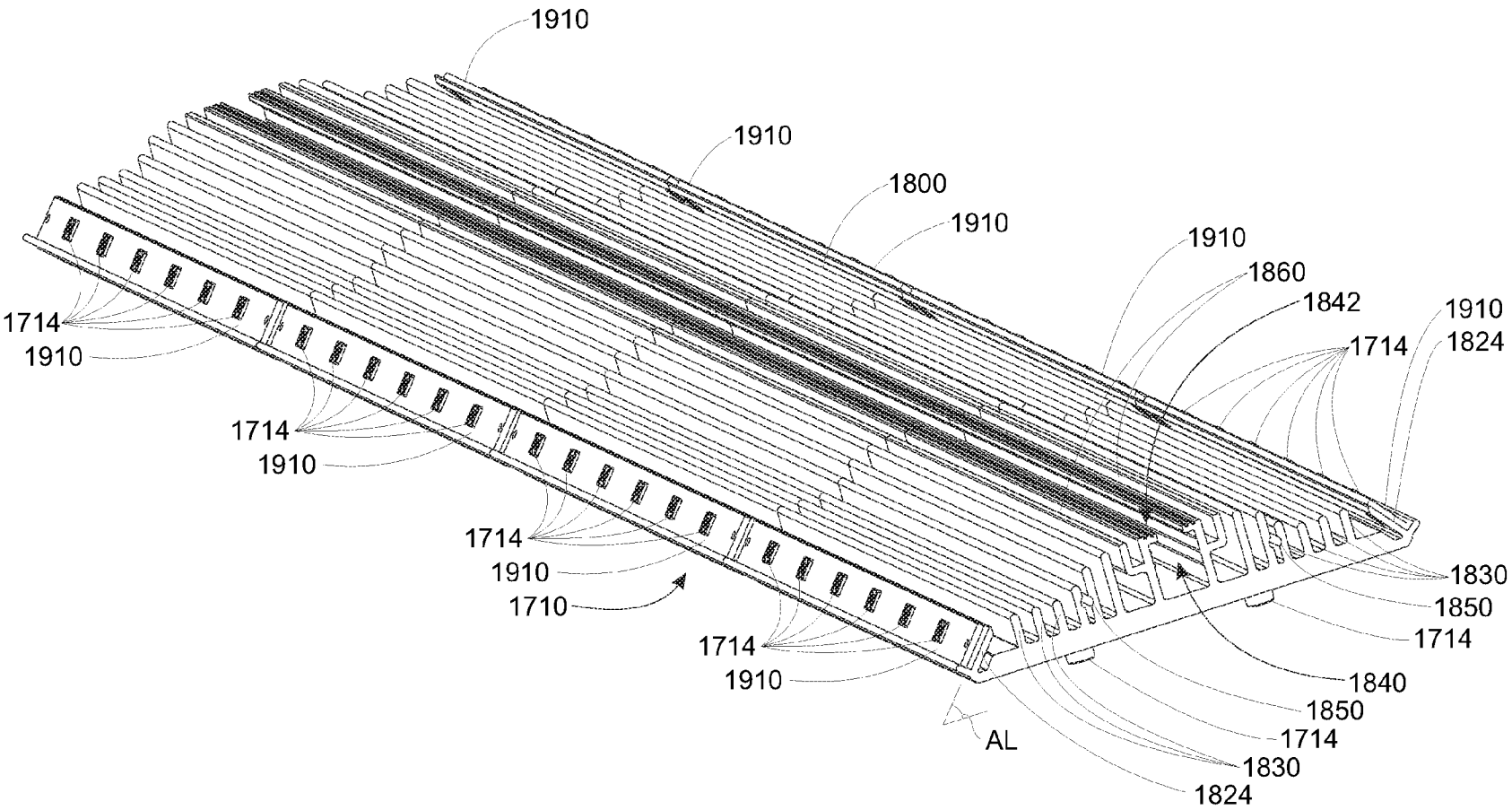
FIG. 19 is a top perspective view of the lamp assembly of FIG. 17 detailing the structure of the heat sink with and end plates and locking mechanism omitted.

The luminaire 100 can support other types of lamps (i.e. other lighting sources), including those operating on differing physical principles than fluorescents. FIG. 17 shows an implementation 1700 of the above-described luminaire in an embodiment in which the lamps comprise an array of light emitting diodes LEDs. In this embodiment, the LEDs are arranged in a lamp assembly 1710 that is attached to, and removed from, the luminaire's rail 390 in a manner similar to the above-described fluorescent lamp assembly 160. With further reference to FIGS. 18 and 19, in this embodiment the lamp assembly 1710 is a heat sink 1800 having a plurality of printed circuit boards 1810 and 1910 that support an arrangement of discrete LED elements 1712 and 1714 (respectively). The harness 1110 is adapted to provide power to the boards from a driver circuit that is contained in the upper housing 120. The LEDs 1712 are arranged at predetermined spacings in two longitudinal lines along the bottom surface of the assembly 1710. In an embodiment there are four separate circuit boards 1810, each having 12 LEDs 1712. In this embodiment, a four-foot lamp assembly thus contains 48 LEDs. This number is highly variable.

The shape and output of the LEDs is highly variable. In an embodiment they are high output, white-light units with a conventional light-spreading lens. A variety of alternate LED units and technologies can be employed in alternate embodiments. For example, a phosphor-coated lens can be used in an alternate embodiment. The LEDs 1712 along the bottom surface of the lamp assembly 1712 provide the majority of the unit's light, and spread close to 180 degrees. The optics of the lens 150 can be adapted to enhance the spread and avoid hot spots. Moreover a diffusive overlay (described further below) can be employed within the interior of the lens to help spread the light. While not employed in this embodiment, in alternate embodiments, the lamp assembly can include reflectors and/or prismatic structures to further spread the emitted light.

Notably, light is spread beyond 180 degrees, and toward the upper regions of the lens by the up-light LEDs 1714 on boards 1910. This is accomplished by mounting the boards at an angle AL with respect to the horizontal (the plane of the assembly's bottom surface) of approximately 45 degrees on an underlying angled base 1824 of the heat sink 1800. The angle AL is highly variable. In this embodiment, each angled board 1910 contains six high-output LEDs 1714 at even spacings. The output of these LEDs is generally lower than that for the main LEDs 1712, and their lenses are generally more directional. The specific parameters for output and light spread are highly variable based upon the desired effect. It is contemplated that the parameters (output, spread, color) of the main LEDs 1712 and/or the up-light LEDS 1714 can vary in different versions of the lamp assembly. This can be accomplished by providing a variety of different circuit boards with different LED parameters, all of which mount on the same heat sink 1800. In this manner, a lamp assembly that is best adapted to the needs of a particular installed space can be mounted in a particular luminaire.

In this embodiment a plurality of circuit boards are used on the heat sink 1800. This allows the overall length of the lamp assembly to be varied. The width of the lamp assembly 1710 is sized to match the interior dimension of the lower housing 110 at the assembly's mounting location therein. In an embodiment, the width is approximately 5.25 inches and the overall length is approximately 48 inches. The heat sink itself can be provided I sections that are joined together using appropriate connectors (not shown). The circuit boards are attached to the heat sink 1800 using screws, rivets, clamps or adhesive or any the acceptable attachment mechanism. A conventional thermal paste is provided between the circuit boards and the surface of the heat sink to facilitate heat transfer from the boards into the body of the heat sink. In this embodiment, the heat sink contains a series of longitudinal ribs 1830 that extend upwardly from the bottom surface as shown. The ribs are higher in the central region of the heat sink and vary in height from approximately 0.5 inch to 1.25 inch in an embodiment. The central region of the heat sink 1800 includes a rectangular channel 1840 that includes a narrowed top slot 1842 with opposing shoulders 1844. As shown in FIG. 17, this channel 1840 is sized and arranged to slide on the rail 390 of the luminaire with clearance for the rail posts 380. The dimensions of the channel 1840 closely match those of the rail 390 for a snug, but slidable fit. The front end of the lamp assembly includes an end plate 1730 (omitted from the views in FIGS. 18 and 19). This end plate is mounted by screws 1732 into the end of the heat sink 1800. The heat sink is an aluminum alloy extrusion in this embodiment, and the screws are received by screw receivers 1850 that are formed between ribs as part of the extrusion. The front end plate 1730 carries the harness base connector 1734. This connector is electrically connected by appropriate leads (not shown) to the LED circuit boards 1810, 1910. The wiring of the boards and interconnection with the harness can be accomplished in a manner known to those of skill in the art. The boards can be separately connected to leads on the base connector 1734, or can be connected to each other via jumpers with one board carrying the lead to the base connector. The front end plate also contains a thumbscrew plate 1742 that selectively engages the locking mechanism 1740. This mechanism swings on a pivot (a fastener mounted in the screw receiver channel 1860) to selectively capture the front post 380 of the rail 390. The screw receiver channel 1860 on each side of the rail channel 1840 also acts as a heat-transfer rib. The screw receiver channels can also be used to mount a rear stop that functions similarly to the above-described stop 1380. A rear end cap 1760 is mounted on the rear end of the heat sink 1800 with a pair of screws that engage the longitudinal screw receivers 1850.

The LED lamps 1712, 1714 can be mounted on the circuit boards in a permanent manner or in a manner that allows for replacement of a malfunctioning unit. For example, the individual LED lamps can include plug connectors or another connection (not shown) of conventional or customized design that allows for ready replacement of a lamp.

The shape of the heat sink, as well as the number of radiating ribs is highly variable. In general, it is recognized that LED lamps generate significant heat when powered. This heat can affect the LED driving circuitry. Thus, the luminaire of this embodiment advantageously separates the circuitry in the upper housing 120 from the heat-generating LEDs in the lower housing 110. This improves performance of the driver circuitry and prolongs its service life by isolating it from the high heat generated by the LEDs. The heat sink provides sufficient surface area to radiate the heat generated by the LEDs and the lens' internal airspace, material and wall thickness are sufficient to transfer the heat radiated by the heat sink to the outside environment. Where appropriate, the top of the lens, caps or other surfaces can be provided with further applied radiative structures (fins, etc) that can work passively or in conjunction with active fans. Likewise, fans can be applied to the heat sink 1800 to cause air movement within the volume of the lower housing 110.

In any of the embodiments contemplated herein, the upper housing 120 can include radiative structures for further cooling. For example, the top cover (740) and the housing sides can be provided with heat-exchange fins, or other structures appropriate to the heat-generation characteristics of the enclosed electronics. Illustratively, the trim panels (191) can be provided with a heat-exchange profile that is adapted to the particular electronics. This enhances the adaptability of the luminaire to a particular type of light and driving electronics. Alternatively, the upper housing's channel member can be customized to accommodate the heat profile generated by the particular type of electronics being employed. In this case, the heat-exchange structures (fins) and other elements (e.g. ornaments, mounting brackets, etc.) can be unitarily formed into the extrusion. Note that the heat-exchange structures provided to the lower housing 110 and/or upper housing 120 for this embodiment and others contemplated herein can be varied based upon the typical environmental temperature range in which the luminaire will be operating. For example, a garage in a warm climate may require a different heat-exchange profile than one in a temperate or arctic climate—or an underground garage with a relatively constant temperature. The versatility of the luminaire can accommodate all of these conditions without significantly altering the underlying structure of the unit.

Notably, because the lower housing is vapor-tight, the potentially moisture-sensitive LED arrays are subjected to a significantly reduced risk of water damage. Likewise, the electronics are sealed against moisture and LED heat in the metallic upper housing thereby improving performance and avoiding overheating.

It should be clear that the illustrative arrangement of main LEDs 1712 and up-light LEDs 1714 is highly variable in number, location and performance characteristics. Likewise, the orientation of the LEDs is highly variable. For example, in an alternate embodiment that bottom of the heat sink 1800 can define V-shape with an apex at the longitudinal centerline with each line of LEDs located on a separate board, on either side of the center line. Each line of LEDs thereby projects along a discrete a non-parallel axis to reduce the hot spot directly below the luminaire. Alternatively, the LED lens can be canted to achieve this non-parallel projection. Likewise LEDs/lenses near either end of the luminaire can be oriented to direct forwardly or rearwardly to provide some additional light past the ends of the luminaire. The structure of the lamp assembly and lens allow for wide variation and versatility in the deployment of LEDs.

IV. Optional Overlay

Figure 20:
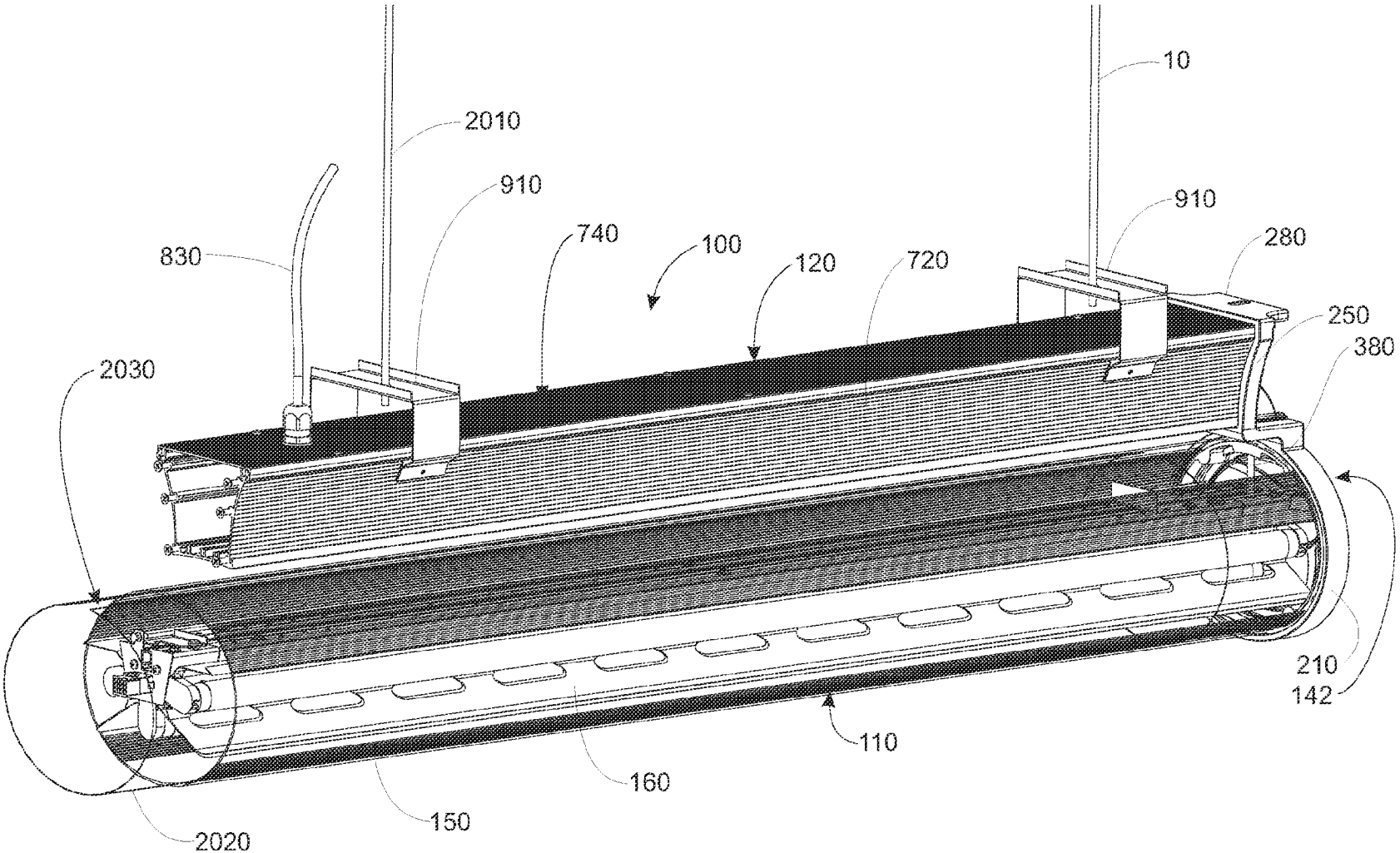
FIG. 20 is an exposed perspective view of the luminaire with an optional overlay that provides a diffusive effect to the lens partially installed within the lens interior.

Reference is now made to FIG. 20, which shows the luminaire 100 with a fluorescent reflector and lamp assembly 160. Any other assembly can be mounted, including the above-described LED lamp assembly in an alternate embodiment. The brackets 910 are also employed in this embodiment, engaging respective mounting posts 2010. The front housing end (140) has been removed so as to expose the end of the lens 150. The continuous surface of the lens and sealed structure facilitates insertion of a thin-sheet, flexible overlay 2020, that can comprise an acrylic (or other polymer) sheet, or any other acceptable material. By way of illustration, the overlay 2020 is shown mostly inserted in the figure. In its final position, it fully overlies the lens interior. The sheet can be frosted, or contain any other acceptable pattern (perforations, screen printing, etc.) that enhances optimetrics. In a typical implementation, the sheet facilitates diffusion of the light projected from the lamps. It can be partially diffusing and partially clear. In alternate embodiment, the sheet can be a pre-formed plastic or metal structure (for example, a white perforated thin metal diffuser). In various embodiments, the sheet or other overlay structure is sized and arranged to include a top gap 2030 that provides clearance for the rail posts 380. The gap can extend the entire length of the overlay 2020, or can comprise notches at either end that provide clearance for each post. The overall longitudinal length of the overlay is approximately the same as the lens' longitudinal length. In an embodiment, a flexible polymer sheet that is normally flat is flexed into a tubular configuration and passed through an open end of the lens, typically with at least one housing end (140 and/or 142) removed as shown. The sheet rebounds from the tubular position under internal spring force, bringing it into close engagement with the interior surface of the lens. It should be clear that one advantage of the overlay according to this embodiment, is that it can be easily changed and customized to provide an appropriate lighting effect for a given lamp type. The overlay can also be used to occlude part of the projected light by providing opaque sections to portions of the overall surface. More generally, the surface finish of some or the entire overlay changes or modifies transmission of light through all or part of the lens. It can be a frosted surface, a tinted surface, a surface that creates a photochemical effect (e.g. a phosphor) or any other surface finish, or combination of surface finishes. For example, the overlay can define a colored logo or lettering.

V. Retrofit/Replacement Procedure

A significant advantage of the novel luminaire according to the embodiments contemplated herein is that a type of lamp assembly can be easily changed, allowing a luminaire that is initially operating with fluorescent lamps to be retrofit with LED lamps and vice versa. In a retrofit procedure (having a series of steps), the technician removes the top cover 740 from the upper housing 120. This may entail first detaching the luminaire from the ceiling if it is flush-mounted or otherwise relatively close to the ceiling surface. The top cover 740 is removed from the upper housing 120 by loosening screws 746. The existing ballast and other lamp-specific electronics is/are accessed and disconnected from the main power feed 830 and from the connecting harness 1110. Alternatively, the entire harness assembly (1110) is removed, which can entail removing the cap 193 to access it. The ballast and other lamp-specific electronics is/are then removed from the luminaire. At this time a new electronics package and (optionally) harness is installed in the upper housing and electrically connected to the power feed. The final connections to line current can be carried out now, or as a safety precaution, after all other tasks have been performed and before the top cover is reattached. Both one end caps 170, 172 are now removed by unscrewing the screws 330, and the connector 1120 is detached from the reflector and lamp assembly's base connector 1130. The harness is moved aside, or removed to make room for the new harness.

The thumbscrew 1362 is loosened and the gate 1370 of the locking mechanism is pivoted out of an interfering position with the front post 380. The lamp assembly is then slid rearwardly so that the stop 1380 becomes adjacent to the rear opening of the lower housing 110. The stop is then removed by loosening the screws 1338 that secure it to the top frame of the lamp assembly. Once the stop 1380 is removed, the lamp assembly is then slid forwardly or rearwardly down the rail and out of the lower housing 110 through the open front end or open rear end (as appropriate). Where the stop 1380 is omitted, or a releasable stop is fitted to the lamp assembly, it may be unnecessary to remove the rear cap 172 or slide the lamp assembly rearwardly. In such cases the lamp assembly is only driven down the rail forwardly to remove it, and the stop (if fitted) is released when it comes into engagement with the front post (380).

Once the old lamp assembly removed, the technician aligns the new, retrofit reflector (if fitted) and lamp assembly with the rail 390, and slides the lamp assembly into the lower housing 110. If the stop has been removed, then the technician slides the assembly rearwardly until the assembly's rear end is accessible through the open rear end of the housing 110. The technician then attaches the stop 1380 using fasteners 1338. The assembly is then moved along the rail 390 until the locking mechanism confronts the front post 380. At this time, the gate 1370 of the locking mechanism is pivoted into an interfering position with the front post 380, and the thumbscrew 1362 is tightened. The connector 1120 from either the original harness or a replacement harness can now be attached to the base connector 1130 in the retrofit assembly. The end caps 170, 172 are reattached to the end of the housing 110 using the screws 330, and the existing (or a replacement) top cover 740 is attached to the upper housing 120 (using screws 746). The luminaire is then reattached to its ceiling (or other surface) mounting if it has been removed therefrom.

During the retrofit, it may be desirable to replace trim panels 191 on the sides of the upper housing. If the old and new trim panels are sufficiently flexible, the old panels can be flexed out of the notches in the channel member 720 that retain it and withdrawn. The new trim panel can be flexed and captured by the notches. If the old or new trim panel is rigid, then one of the housing ends 140, 142 is removed (loosening screws 370, and the old trim panels are slid out the exposed end of the channel member 720. New trim panels are then slid in and the housing end 140, 142 is reattached. It can be desirable to replace various gaskets at this time. All gaskets can be replaced by removing the end caps 170, 172 and housing ends 140, 142. Likewise, if the lens 150 has become worn, or new optimetrics are needed for the new lamp assembly, then the lens can also be replaced at this time. All components of the luminaire are readily replaced with a minimum of effort.

It is expressly contemplated that the above-described steps can be applied in whole or in part to replace the electronics or a reflector and lamp assembly in a non-retrofit procedure—that is, replacing one component with the same type of component. Likewise, the same steps can be employed to switch from an LED or other light type to a fluorescent light type. It is also expressly contemplated that a variety of other lamp types (or combinations of different lamp types) can be employed in an assembly. For example, an assembly having side LED arrays and a bottom fluorescent lamp can be employed, and both types of driving electronics are provided in the housing (which desirably has room for a relatively large package). An assembly having a plurality of incandescent lamps can be employed. Other lamp types, such as plasma discharge, xenon, or neon can also be employed.

It should be clear that vapor-tight luminaire of the various embodiments contemplated herein provides a versatile and energy-efficient lighting system that reduces service costs, extends electronics and lamp life through moisture and thermal isolation, and provides superior optimetrics. In addition, the luminaire of this embodiment supports a variety of pleasing designs and shapes that are not available in current vapor-tight designs. Moreover, the luminaire of the various embodiments allows for straightforward retrofit to support new lighting styles and technologies, which thereby enables a given installation to keep up with current lighting, energy and environmental demands, without full loss of the initial capital investment in the system.

The foregoing has been a detailed description of illustrative embodiments of the invention. Various modifications and additions can be made without departing from the spirit and scope of this invention. Each of the various embodiments described above may be combined with other described embodiments in order to provide multiple features. Furthermore, while the foregoing describes a number of separate embodiments of the apparatus and method of the present invention, what has been described herein is merely illustrative of the application of the principles of the present invention. For example, the lamp reflector mounting structure is constructed with a rigid top frame and stamped core housing. Alternatively is can be a solid structure or a unitary hollow structure. Also, while a single multi-pin connector arrangement is provided between the reflector/lamp assembly and the electronics package, these connections can be made using a plurality of connectors or by another conventional arrangement, such as twist caps, pushdown connectors or terminal strips. Also, while the lens is clear or white translucent in various embodiments, in alternate embodiments all or portions of the lens can be provided with a color-tinted finish or another optical effect (polarization, for example) that optimizes the performance and optimetrics of the particular type of lamps and their geometric arrangement within the luminaire. Also, while not shown, it is expressly contemplated that at least one of the end caps can be replaced with a sealed coupler that allows a pair of luminaires according to an embodiment herein to be joined together in a sealed relationship. Electrical connections for each lamp assembly can be provided through a single unit or separately via each joined unit in a manner described above. In addition, while each lens edge is shown as residing in a plane and vertical, it is contemplated that the lens edge can be non-vertical, or contain inset or extended edge sections (e.g. notches or tabs in the lens edge). The housing end ring and gasket can be shaped to accommodate the geometry of such a non-planar and/or non-vertical lens edge. Moreover, while LEDs are shown attached to circuit boards, the LEDs can alternately be attached individually or in smaller groupings to the heat sink or other base structure. Accordingly, this description is meant to be taken only by way of example, and not to otherwise limit the scope of this invention.

What is claimed is:

1. A vapor-tight luminaire comprising:

a vapor-tight lower housing defining a continuous and unbroken sealed tubular lens having a pair of end cap structures, the lower housing removably supporting a lamp assembly;

an upper housing separated from the lower housing along an elongated length thereof between the end cap structures, the upper housing containing electronics for operating the lamp assembly and being interconnected with line current; and an interconnecting harness extending along at least one of the end cap structures between the electronics and the lamp assembly.

2. The vapor-tight luminaire as set forth in claim 1 wherein each of the end cap structures includes a housing end that sealingly joins a respective end of the upper housing and a respective end of the tubular lens, and at least one housing end receives a removable end cap that allows access to an interior of the lower housing.

3. The vapor-tight luminaire as set forth in claim 2 wherein the end cap defines an interior volume that extends outward from the housing end.

4. The vapor-tight luminaire as set forth in claim 3 wherein the lamp assembly includes a first part of an electrical connector assembly and the interconnecting harness includes a second, mating, part of the electrical connector assembly, the electrical connector assembly residing in the volume of the end cap.

5. The vapor-tight luminaire as set forth in claim 4 wherein the end cap defines a light-transmitting dome.

6. The vapor-tight luminaire as set forth in claim 2 wherein the housing end is removably secured to the respective end of the upper housing by fasteners and sealingly compresses against the respective end of the tubular lens.

7. The vapor-tight luminaire as set forth in claim 6 further comprising a gasket between the housing end and the respective end of the upper housing.

8. The vapor-tight luminaire as set forth in claim 2 wherein the interconnecting harness exits the housing end adjacent to the respective end of the upper housing and reenters the housing end adjacent to the respective end of the tubular lens.

9. The vapor-tight luminaire as set forth in claim 8 wherein the housing end includes a cap that removably and sealingly covers a portion of the interconnecting harness between where the interconnecting harness exits the housing end adjacent to the respective end of the upper housing and reenters the housing end adjacent to the respective end of the tubular lens.

10. The vapor-tight luminaire as set forth in claim 1 wherein the housing end defines a vertical plate that defines an end of the upper housing and a ring that defines an end of the lower housing, and wherein the vertical plate is inset by a leg with respect to the ring.

11. The vapor-tight luminaire as set forth in claim 10 wherein the vertical plate includes an outwardly extended base with an aperture for receiving a mounting post.

12. The vapor-tight luminaire as set forth in claim 1 wherein the tubular lens comprises a light-transmitting polymer and the upper housing is at least in part composed of metal.

13. The vapor-tight luminaire as set forth in claim 1 wherein the tubular lens defines an ovular cross section along a plane perpendicular to an axis along the elongated length.

14. The vapor-tight luminaire as set forth in claim 1 wherein the upper housing includes a lower channel member defining a bottom and sides and a removable top cover.

15. The vapor-tight luminaire as set forth in claim 14 wherein the top cover includes a harness that interconnects the line current at an external source.

16. The vapor-tight luminaire as set forth in claim 1 wherein the lamp assembly is slidably mounted with respect to posts on each of the mounting brackets so as to be removable through an opening when the end cap is removed from the lower housing.

17. The vapor-tight luminaire as set forth in claim 16 wherein the posts support a rail extending therebetween and the lamp assembly includes a channel that captures the rail and allows sliding relative thereto.

18. The vapor-tight luminaire as set forth in claim 17 wherein the lamp assembly includes a locking mechanism that selectively engages at least one of the posts and secures the lamp assembly against sliding along the rail.

19. The vapor-tight luminaire as set forth in claim 1 wherein the lamp assembly includes a pair of side fluorescent lamps and a bottom fluorescent lamp separated by reflector panels.

20. The vapor-tight luminaire as set forth in claim 19 wherein the electronics includes at least one fluorescent ballast.

21. The vapor-tight luminaire as set forth in claim 20 wherein the reflector panels respectively between the side fluorescent lamps and the bottom fluorescent lamps include slots allowing light transmission therethrough.

22. The vapor-tight luminaire as set forth in claim 20 wherein the tubular lens includes fluting located with respect to the reflector panels.

23. The vapor-tight luminaire as set forth in claim 22 wherein the tubular lens includes an opaque top section formed as a co-extrusion.

24. The vapor-tight luminaire as set forth in claim 1 wherein the lamp assembly includes an array of LED lamps.

25. The vapor-tight luminaire as set forth in claim 24 wherein the electronics includes at least one LED driver circuit.

26. The vapor-tight luminaire as set forth in claim 25 wherein the LED lamps are provided on a circuit board arrangement with respect to a bottom surface of a heat sink, a top surface of the heat sink being removably mounted to the lower housing.

27. The vapor-tight luminaire as set forth in claim 26 wherein the heat sink includes a pair of side edges oriented so as to support a plurality of up-light LEDs therealong.

28. The vapor-tight luminaire as set forth in claim 1 wherein the lamp assembly comprises a plurality of fluorescent lamps separated by reflector panels.

29. The vapor-tight luminaire as set forth in claim 1 wherein at least a portion of the lamp assembly and the upper housing is constructed as a metal extrusion including channels for receiving threaded fasteners thereinto.

30. The vapor-tight luminaire as set forth in claim 1 further comprising an overlay removably located against an interior surface of the lens around at least a portion of a perimeter thereof, the overlay defining a surface that alters the transmission of light through the lens.

31. A vapor-tight luminaire comprising:

a vapor tight housing having at least one removable sealed end cap and a unitary sealed tubular lens that transmits light through at least a portion thereof, the housing including a support assembly within its interior; and a lamp assembly constructed and arranged to slidably engage and disengage the support assembly, the support assembly extending through the tubular lens and being attached only at each end cap when the lamp assembly is respectively passed into and out of an end of the housing with the at least one removable end cap removed therefrom.

32. The vapor-tight luminaire as set forth in claim 31 further comprising an upper housing mounted from opposing end of the vapor-tight housing and containing electronics that drive the lamp assembly, the electronics being interconnected by a harness to the lamp assembly passing through a housing end adjacent to an end of the vapor-tight housing.

33. The vapor-tight luminaire as set forth in claim 32 wherein the lamp assembly includes at least one of a plurality of LED lamps or fluorescent lamps.

34. The vapor-tight luminaire as set forth in claim 31 wherein the lamp assembly comprises a heat sink having a channel that removably engages the support assembly and having mounted thereon a plurality of circuit boards, each of the circuit boards including a plurality of LED units thereon.

35. The vapor-tight luminaire as set forth in claim 34 wherein the heat sink includes a bottom surface having the circuit boards and a pair of opposing, angled edge surfaces having up-light LEDs mounted thereon.

36. The vapor-tight luminaire as set forth in claim 31 wherein the support assembly includes a rail extending through the tubular lens and the lamp assembly includes a channel that captures the rail and allows sliding relative thereto, the rail being attached to each of the end caps by a respective post.

37. A method for replacing or retrofitting a lamp assembly in a luminaire comprising the steps of:

providing (a) a vapor-tight lower housing defining a continuous and unbroken sealed tubular lens having a pair of end cap structures and a lamp assembly contained therein, (b) an upper housing separated from the lower housing along an elongated length thereof between the end cap structures, the upper housing containing electronics for operating the lamp assembly and being interconnected with line current, and (c) an interconnecting harness between the electronics and the lamp assembly;

removing an end cap respectively from at least one of the end cap structures to define an end opening in the lower housing;

disconnecting the lamp assembly from the interconnecting harness;

sliding the lamp assembly through the end opening and out of the lower housing;

sliding a replacement lamp assembly through the end opening and into a final position therein;

connecting the interconnecting harness to the replacement lamp assembly; and attaching the end cap to the one of the end cap structures to form a vapor-tight seal at the lower housing.

38. The method as set forth in claim 37 further comprising accessing the upper housing and replacing the electronics so that the replacement electronics drive the replacement lamp assembly.

* * * * *